US008242985B2

(12) United States Patent
Kishi et al.

(10) Patent No.: US 8,242,985 B2
(45) Date of Patent: Aug. 14, 2012

(54) DISPLAY DEVICE AND METHOD FOR MANUFACTURING THE SAME

(75) Inventors: Noritaka Kishi, Osaka (JP); Akira Tagawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 314 days.

(21) Appl. No.: 12/733,747

(22) PCT Filed: Sep. 11, 2008

(86) PCT No.: PCT/JP2008/066440

§ 371 (c)(1),
(2), (4) Date: Mar. 18, 2010

(87) PCT Pub. No.: WO2009/075129

PCT Pub. Date: Jun. 18, 2009

(65) Prior Publication Data

US 2010/0238149 A1 Sep. 23, 2010

(30) Foreign Application Priority Data

Dec. 11, 2007 (JP) ..... 2007-319969

(51) Int. Cl.
*G09G 3/30* (2006.01)

(52) U.S. Cl. ..... 345/76; 345/77; 345/82; 345/83; 345/204; 345/206; 315/169.1; 315/169.3

(58) Field of Classification Search ..... 345/76–83, 345/39, 44–46, 204, 690; 315/169.1–169.3
See application file for complete search history.

(56) References Cited

U.S. PATENT DOCUMENTS 6,229,506 B1 5/2001 Dawson et al.
6,909,242 B2 * 6/2005 Kimura ..... 315/169.3
7,515,148 B2 * 4/2009 Lee ..... 345/204
7,646,364 B2 * 1/2010 Yamashita et al. ..... 345/77
(Continued)

FOREIGN PATENT DOCUMENTS

JP 2002-514320 A 5/2002
(Continued)

OTHER PUBLICATIONS

International Search Report WIPO WO 9848403 May 14, 2002.
Supplementary European Search Report dated Dec. 27, 2010.
(Continued)

*Primary Examiner* — Quan-Zhen Wang
*Assistant Examiner* — Jennifer Nguyen
(74) *Attorney, Agent, or Firm* — Harness, Dickey & Pierce, P.L.C.

(57) ABSTRACT

A pixel circuit (Aij) has a capacitor (Cs) having one of ends connected with a gate terminal of a DTFT (driving TFT) and the other end connected with a capacitance feedback line (CSi), a current-voltage conversion circuit (14) having an input terminal to which a feedback current flowing to a DDTFT (dummy driving circuit) is input when a predetermined potential is supplied to a gate terminal of the DDTFT having TFT characteristics substantially same as those of the DTFT in the pixel circuit (Aij) during a selected period for converting the feedback current into voltage and outputting a potential according to the voltage from an output terminal, and a changeover switch (CSW) for connecting the capacitance feedback line (CSi) corresponding to the pixel circuit (Aij) with the current-voltage conversion circuit (14) during the selected period and connecting the capacitance feedback line (CSi) corresponding to the pixel circuit (Aij) during a non-selected period with a constant potential supply line for supplying a constant potential (Vref). Thus, degradation in display quality due to a variation in DTFT characteristics of the pixel circuit can be inhibited while preventing enlargement of a circuit scale in a current-control-type display device.

12 Claims, 9 Drawing Sheets

U.S. PATENT DOCUMENTS

| | | | |
|---|---|---|---|
| 2003/0058687 | A1 | 3/2003 | Kimura |
| 2005/0231123 | A1 | 10/2005 | Kimura |
| 2006/0114200 | A1 | 6/2006 | Yamashita et al. |
| 2006/0139252 | A1 | 6/2006 | Lee |

FOREIGN PATENT DOCUMENTS

| | | | |
|---|---|---|---|
| JP | 2002-278513 | A | 9/2002 |
| JP | 2004-054200 | A | 2/2004 |
| JP | 2006-154521 | A | 6/2006 |

* cited by examiner

DISPLAY DEVICE AND METHOD FOR MANUFACTURING THE SAME

TECHNICAL FIELD

The present invention relates to a current-controlled display device using an element whose luminescence condition changes in line with a current amount, such as an organic EL (electroluminescent) display and a FED (Field Emission Display), and to a method for manufacturing the same.

BACKGROUND ART

In recent years, along with an increase in demands for lightweight, thin and highly responsive display, there has been an intensification of research and development efforts regarding organic EL (electroluminescent) displays and FEDs (Field Emission Display).

Because driving period, ambient temperature and the like wield a great influence on a relation between luminance and voltage in organic EL elements, it is difficult to suppress variations in luminance through a voltage-controlled driving method. On the other hand, luminance and current have a proportionality relation in organic EL elements, and influence of external factors such as ambient temperature is limited. As a result, current-controlled driving methods are the most often used as driving methods in organic EL displays.

In this regard, in the case of such display devices, a TFT (Thin Film Transistor) is used as a switching element included in a pixel circuit and in a driving circuit. Further, in such a TFT, amorphous silicon, low-temperature polycrystalline silicon, CG (Continuous Grain) silicon and the like are used.

However, regarding TFTs, such a problem occurs that, in general, variations in characteristics (driving abilities) such as threshold value (threshold voltage) and mobility are likely to occur.

Especially, in the case of polycrystalline silicon (p-Si), which is mainly used in small-sized appliances such as portable telephones, variations in characteristics are likely to occur at a joint of laser-scanned areas, because a manufacture operation of polycrystalline silicon includes laser annealing. In other words, when applied to a panel, an area annealed during one laser scan (laser irradiation) is relatively homogeneous. However, variations in TFT characteristics at a face of a border of the laser scanned-area are easily noticeable as streaked image defects. Further, in some cases, variations in TFT characteristics also occur in the area annealed during one laser scan (laser irradiation), resulting in display unevenness in an image.

Conventional methods to compensate such variations in characteristics include the following: (1) a method in which a circuit to compensate the variations in characteristics is provided inside a pixel circuit; and (2) a method in which a compensation function is provided externally.

For example, Patent Literature 1 discloses a configuration, using the above method (1), of a pixel circuit in an organic EL display device.

FIG. 9 is an explanatory view showing a circuit configuration of a pixel circuit disclosed in Patent Literature 1. The pixel circuit 100 shown on this figure includes a driving TFT 110, switching TFTs 120, 130, and 140, capacitors 150 and 160, and an organic electroluminescent element (organic electroluminescent display, OLED) 170. Both TFTs are P-channel TFTs.

A source terminal of the driving TFT 11 is connected to a power supply line 184 (+VDD), and a drain terminal of the driving TFT 11 is connected to a source terminal of the switching TFT 130. Further, a drain terminal of the switching TFT 130 is connected to a GND (ground, common cathode) via the organic EL element 170. Further, a gate terminal of the driving TFT 110 is connected to one terminal of the capacitor 160, and the other terminal of the capacitor 160 is connected to a drain terminal of the switching TFT 140. Further, a source terminal of the switching TFT 140 is connected to a data line 180, and a gate terminal of the switching TFT 140 is connected to a select line 181. Further, a source terminal of the switching TFT 120 is connected between the gate terminal of the driving TFT 110 and the capacitor 160; a drain terminal of the switching TFT 120 is connected between the drain terminal of the driving TFT 110 and a source terminal of the switching terminal 130; a gate terminal of the switching terminal 120 is connected to an auto-zero line 182. Further, a gate terminal of the switching TFT 130 is connected to an illumination line 183. Further, one terminal of the capacitor 150 is connected to the power supply line 184, and the other terminal is connected between the gate terminal of the driving TFT 110 and the capacitor 160.

FIG. 10 is an explanatory drawing showing an operation timing of the pixel circuit 100.

In a first period, the auto-zero line 182 and the illumination line 183 are set to have a "low" potential. This makes the switching TFT 120 and the switching TFT 130 conductive, and makes potentials of the drain terminal and the gate terminal of the driving TFT 110 identical. At that time, the driving TFT 110 also becomes conductive, and a current starts flowing from the power supply line 184 to the organic EL element 170 via the driving TFT 110 and the switching TFT 130. At that time, a data line 180 is set to have a reference potential Vstd; further, the select line 181 is set to have a "low" potential and a terminal of the capacitor 160 which is closer to the switching TFT 140 is set to have a reference potential Vstd.

Next, in a second period, the switching TFT 130 is rendered nonconductive by setting the illumination line 183 to have a "high" potential. In such a nonconductive state, a current from the power supply line 184 flows into the gate terminal of the driving TFT 110, via the driving TFT 110 and the switching TFT 120. Then, the potential of the gate terminal of the driving TFT 110 gradually increases; when the potential of the gate terminal of the driving TFT 110 reaches a value (+VDD+Vth) corresponding to a threshold value voltage Vth (Vth being a negative value, and a voltage between the gate and the source of the driving TFT 110), the driving TFT 110 becomes nonconductive.

In a third period, the switching TFT 120 is rendered nonconductive by setting the auto-zero line 182 to have a "high" potential. This makes a difference between a potential of the gate terminal of the switching TFT 120 and the reference potential at that time, and the difference is stored in the capacitor 160. In other words, when a potential of the data line 180 is equal to a reference potential Vstd, the potential of the gate terminal of the driving TFT 110 becomes a value (+VDD+Vth) corresponding to a threshold value state (i.e. a state in which a potential difference between the gate and the source of the driving TFT 110 is the threshold value voltage Vth).

In a fourth period, the potential of the data line 180 is changed from the reference potential Vstd to a data potential Vdata. In this state, the potential of the gate terminal of the driving TFT 110 is changed only by a value equal to a difference in potential between the reference potential Vstd and the data potential Vdata.

During the third period, the driving TFT 110 is set to a threshold value state, so that flows a current corresponding to the difference in potential between the reference potential Vstd and the data potential Vdata. Accordingly, it is possible to determine a current depending on the difference in potential between the reference potential Vstd and the data potential Vdata, regardless of the threshold value voltage Vth of the driving TFT 110.

Subsequently, in a fifth period, the switching TFT 140 is rendered nonconductive by setting the select line 181 to have a "high" potential. Thus, the potential of the gate terminal of the driving TFT 110 is maintained as a voltage between terminals of the capacitor 150, and the selection period of the pixel circuit 100 is finished.

Subsequently, by setting the illumination line 183 to have a "low" potential, the current set as above during the fourth period flows in the organic EL element 170 via the driving TFT 110.

This way, in the pixel circuit 100 shown in FIG. 9, because the current flowing in the driving TFT 110 is determined without being influenced by variations of the threshold value voltage Vth, it becomes possible to set up the current to be outputted to the organic EL element 170 without having to take into account variations of the threshold value voltage of the TFT.

Further, as an example of the above method (2), Patent Literature 2 discloses the following technology: a current capability of each driving element is measured and stored in a memory provided on an external circuit; a data potential supplied to each pixel at the time of panel display is modified in line with the capability of the driving element. Specifically, in Patent Literature 2, a current measurement element is provided for each power supply line supplying a current to an organic EL element of each pixel circuit; a scanning voltage is applied to one scanning line; in synchronization with the application, a predetermined data potential is supplied to each data line, and a current value of a current flowing in the organic EL element is measured by the current measurement element; subsequently, the scanning voltage is applied to the scanning line mentioned above, a data signal setting an electro-optical element to level 0 is supplied to each data line in synchronization with the application, and a current value of a current flowing in the organic EL element is measured by the current measurement element with respect to each scanning line; based on the current thus measured, the data potential to be applied to an active element of each pixel is corrected.

CITATION LIST

Patent Literature 1

Japanese Translation of PCT International Application, Tokuhyou, No. 2002-514320 (Publication Date: May 14, 2002)

Patent Literature 2

Japanese Patent Application Publication, Tokukai, No. 2002-278513 (Publication Date: Sep. 27, 2002)

SUMMARY OF INVENTION

However, with the technology disclosed in Patent Literature 1, because it is necessary to provide 4 TFTs and 2 capacitors for each pixel circuit 100, such problems occur that an open area ratio of a pixel decreases and that a yield ratio decreases.

Further, with the technology disclosed in Patent Literature 2, even though it is possible to minimize an enlargement of a circuit configuration of a pixel circuit by using an external circuit to conduct current correction, problems such as an increase in a manufacturing cost of the display device as a whole and such as an increase in an area where the external circuit is mounted occur, because it is necessary to provide on the external circuit a memory to store a current capability of all pixel circuits.

The present invention is attained in view of the above-described problems. An object of the present invention is to suppress, in a current-controlled display device, a decrease in display quality caused by variations in characteristics of driving TFTs included in a pixel circuit, while keeping to a minimum an increase in a circuit scale of the pixel circuit and of an external circuit.

In order to solve the above-mentioned problems, a display device in accordance with the present invention includes: (i) a plurality of scanning lines; (ii) a plurality of data lines intersecting with each of the plurality of scanning lines; (iii) pixel circuits disposed so as to correspond to each intersection of the scanning lines and the data lines; (iv) a source driver for supplying, to the data lines, a data potential corresponding to image data; and (v) a scanning driver for supplying, to the scanning lines, a scanning signal to switch each of the pixel circuits between a selection period during which the data potential outputted from the source driver is supplied to each of the pixel circuits, and a non-selection period during which the data potential is not supplied to each of the pixel circuits, each of the pixel circuits including: (i) a switching TFT, whose gate terminal is connected to the scanning lines and whose source terminal is connected to the data lines; (ii) a driving TFT, whose gate terminal is connected to a drain terminal of the switching TFT and whose source terminal is connected to a current supply line maintained at a power supply potential; and (iii) an optical element connected to a drain terminal of the driving TFT, a luminescence condition of the optical element varying in line with an amount of a current flowing in the optical element, the display device being a current-controlled display device displaying an image corresponding to the image data by controlling, via the driving TFT in line with the data potential, the amount of the current flowing in the optical element, each of the pixel circuits having a retention capacitor one end of which is connected to a gate terminal of the driving TFT and the other end is connected to a capacitance feedback line, the display device further including: (i) a current-voltage conversion circuit for receiving at its input terminal a feedback current which is a current flowing in the driving TFT of a pixel circuit in the selection period at a time of supplying a predetermined potential to the gate terminal of the driving TFT, converting the feedback current into a voltage, and outputting at its output terminal a potential corresponding to the voltage; and (ii) a changeover switch to connect the capacitance feedback line to the output terminal of the current-voltage conversion circuit when the pixel circuit to which the capacitance feedback line corresponds is in the selection period and to connect the capacitance feedback line to a fixed potential supply line supplying a fixed potential when the pixel circuit to which the capacitance feedback line corresponds is in the non-selection period.

With the above configuration, the current-voltage conversion circuit receives at its input terminal a feedback current which is a current flowing in the driving TFT of a pixel circuit in the selection period at a time of supplying a predetermined potential to the gate terminal of the driving TFT, converts the feedback current into a voltage, and outputs at its output terminal a potential corresponding to the voltage. Further, the changeover switch connects the capacitance feedback line to the output terminal of the current-voltage conversion circuit when the pixel circuit to which the capacitance feedback line corresponds is in the selection period. This way, a potential in line with the TFT characteristics of the driving TFT provided on the pixel circuit is supplied to the one end of the retention capacitor in the pixel circuit during the selection period, and the data potential is supplied to the other end of the retention capacitor. Further, when the pixel circuit enters the non-selection period, the capacitance feedback line is connected, by the changeover switch, to a fixed potential supply line supplying a fixed potential. As a result, the potential supplied to one end of the retention capacitor connected to the capacitance feedback line is shifted by only the fixed potential. This way, during the selection period, it is possible to supply to the gate terminal of the driving TFT a data potential obtained by correcting a data potential corresponding to image data in accordance with the TFT characteristics of the driving TFT. Accordingly, it is possible to prevent the occurrence of image defects caused by variations in TFT characteristics of the driving TFT included in the pixel circuit.

Further, because the present configuration allows for a simplified pixel circuit configuration, compared to conventional configurations including a circuit used to compensate variations in TFT characteristics inside the pixel circuit, the present configuration makes it possible to increase an open area ratio of a display area. Further, because it is sufficient to merely provide the current-voltage conversion circuit as an external circuit provided outside the display area, it is possible to minimize an increase in a scale of the external circuit.

Further, the display device of the present invention may be arranged so that a pixel circuit provided at an end of each scanning line in an extending direction thereof is a dummy pixel circuit provided outside a display area; and when a predetermined potential is applied to a gate terminal of a driving TFT provided in the dummy pixel circuit while a pixel circuit in a display area which is connected to said each scanning line is in the selection period, a current flows in the driving TFT, and the current is inputted as the feedback current to the current-voltage conversion circuit.

With the above configuration, it is possible to prevent an occurrence, between pixels adjacent in a direction perpendicular to the extending direction of the scanning line, of streaked image defects caused by variations in TFT characteristics of the driving TFT included in the pixel circuit. Further, a current output circuit to output to the current-voltage conversion circuit a feedback current is required to be provided only on the dummy pixel circuit provided outside the display area and not on each pixel circuit inside the display area, and therefore it is possible to increase the open area ratio of the display area.

Further, the display device of the present invention may be arranged so that: the dummy pixel circuit does not include an optical element; the driving TFT provided in the dummy pixel circuit is a dummy driving TFT having substantially same TFT characteristics as those of a driving TFT of the pixel circuit in the display area which is connected to the scanning line corresponding to the dummy pixel circuit; and when a predetermined potential is supplied to a gate terminal of the dummy driving TFT in the dummy pixel circuit corresponding to the scanning line connected to the pixel circuit in the selection period, a current flows in the dummy driving TFT, and the current is inputted as the feedback current to the current-voltage conversion circuit.

With the above configuration, the dummy driving TFT has substantially the same TFT characteristics as those of the driving TFT. Accordingly, by inputting into the current-voltage conversion circuit, as the feedback current, the current flowing in the dummy driving TFT when the predetermined potential is applied to the gate terminal of the dummy driving TFT, it is possible to supply, to the gate terminal of the driving TFT included in each pixel circuit in the display area which is connected to the scanning line corresponding to the dummy pixel circuit including the dummy driving TFT, a data potential obtained by correcting a potential corresponding to image data in accordance with the TFT characteristics of the driving TFT. This way, it is possible to prevent the occurrence, between pixels adjacent in a direction perpendicular to the extending direction of the scanning line, of streaked image defects caused by variations in TFT characteristics of the driving TFT included in the pixel circuit. Further, it is only necessary to provide the current-voltage circuit for each scanning line or each group of scanning lines and it is not necessary to provide the current output circuit (used to output the feedback current to the current-voltage conversion circuit) on each pixel circuit inside the display area, and therefore it is possible to simplify the circuit configuration of each pixel circuit.

Further, the display device of the present invention may be arranged so that the dummy pixel circuit includes: the dummy driving TFT; a dummy switching TFT, whose gate terminal is connected to the scanning line, whose source terminal is connected to a dummy data line used to supply a predetermined potential, and whose drain terminal is connected to the gate terminal of the dummy driving TFT; and a switching element disposed between the dummy driving TFT and an input terminal of the current-voltage conversion circuit, the switching element being connected to the scanning line, wherein the dummy switching TFT and the switching element are conductive when the pixel circuit in the display area which is connected to the scanning line corresponding to the dummy pixel circuit is in the selection period, and the dummy switching TFT and the switching element are cutoff when the pixel circuit in the display area which is connected to the scanning line corresponding to the dummy pixel circuit is in the non-selection period. Further, the display device of the present invention may be arranged so that the dummy pixel circuit further comprises a second switching element connected to the gate terminal of the dummy driving TFT, and the second switching element supplies a predetermined potential to the gate terminal of the dummy driving TFT when the pixel circuit in the display area which is connected to the scanning line corresponding to the dummy pixel circuit is in the selection period, and the second switching element supplies to the gate terminal of the dummy driving TFT a potential to cutoff the dummy switching TFT when the pixel circuit in the display area which is connected to the scanning line corresponding to the dummy pixel circuit is in the non-selection period.

With each of the above configurations, while it is possible to achieve a dummy pixel circuit with a simple structure, it is also possible to detect with a high precision a current flowing in the driving TFT at the time of supplying the predetermined potential to the gate terminal of the driving TFT.

Further, the display device of the present invention may be arranged so that each driving TFT is formed via crystallization by laser annealing, the laser annealing being conducted by scan processing in which a laser irradiation spot travels alongside an extending direction of the scanning line, the scan processing being sequentially repeated by shifting position of the scan processing in a direction perpendicular to the extending direction of the scanning line; and the dummy pixel circuit is provided: for each scanning line; or for every group of scanning lines each connected to a pixel circuit including the driving TFT within the laser irradiation spot in one scan processing.

With the above configuration, the dummy driving TFT and the driving TFT of each pixel circuit connected to the scanning line corresponding to the dummy pixel circuit including the dummy driving TFT are crystallized by one scan processing. Accordingly, it is possible to give, to the dummy driving TFT, TFT characteristics substantially the same as the TFT characteristics of each driving TFT. As a result, it is possible to prevent with higher precision the occurrence, between pixels adjacent in a direction perpendicular to the extending direction of the scanning line, of streaked image defects caused by variations in the TFT characteristics of the driving TFT included in the pixel circuit. Especially, streaked image defects caused by variations in the TFT characteristics of the driving TFT are likely to occur at a junction between laser irradiation spots during two separate scan processings; however, with the above configuration, it is possible to prevent the occurrence of streaked image defects at the junction between laser irradiation spots.

Further, the display device of the present invention may be arranged so that a shape and dimensions of the dummy driving TFT are substantially same as a shape and dimensions of the driving TFT included in the pixel circuit in the display area which is connected to the scanning line corresponding to the dummy pixel circuit including the dummy driving TFT.

With the above configuration, it is possible to make the TFT characteristics of the dummy driving TFT substantially the same as the TFT characteristics of the driving TFT included in the pixel circuit inside the display area which is connected to the scanning line corresponding to the dummy pixel circuit including the dummy driving TFT. As a result, it is possible to prevent with higher precision the occurrence, between pixels adjacent in a direction perpendicular to the extending direction of the scanning line, of streaked image defects caused by variations in the TFT characteristics of the driving TFT included in the pixel circuit. Especially, streaked image defects caused by variations in the TFT characteristics of the driving TFT are likely to occur at the junction between laser irradiation spots during two separate scan processings; however, with the above configuration, it is possible to prevent the occurrence of streaked image defects at the junction between laser irradiation spots.

Further, the display device of the present invention may be arranged so that at least one of pixel circuits connected to a same scanning line includes a switching means to switch a connection of a drain terminal of the driving TFT between the optical element and the input terminal of the current-voltage conversion circuit, the switching means being connected between the drain terminal of the driving TFT and the optical element; during a first half of the selection period of the pixel circuit connected to the scanning line, a predetermined potential is supplied to the gate terminal of the driving TFT via the data line, and the switching means is caused to switch the connection so that the drain terminal is connected to the input terminal of the current-voltage conversion circuit in order that a current flowing in the driving TFT is inputted as a feedback current into the current-voltage conversion circuit; and during a second half of the selection period, a data potential corresponding to image data is supplied to the gate terminal of the driving TFT via the data line, and the switching means is caused to switch the connection so that the drain terminal is connected to the optical element.

With the above configuration, it is possible to prevent the occurrence, between pixels adjacent in a direction perpendicular to the extending direction of the scanning line, of streaked image defects caused by variations in TFT characteristics of the driving TFT included in the pixel circuit. Further, because it is sufficient to merely provide the switching means on a conventionally-known general pixel circuit, it is possible to minimize enlargement of the circuit configuration of the pixel circuit.

Further, the display device of the present invention may be arranged so that the current-voltage conversion circuit comprises: a current-voltage conversion element made from a diode-connected transistor; and a current mirror circuit flowing into the current-voltage conversion element a current of a same amount as an amount of the feedback current inputted into the input terminal, and the feedback current is converted into a voltage using the current-voltage conversion element, and a potential corresponding to the voltage is then outputted from the output terminal.

With the above configuration, because it is possible to achieve a current-voltage conversion circuit with a simple structure, it is possible to minimize enlargement of the circuit configuration of the external circuit.

Further, the display device of the present invention may be arranged so that the current-voltage conversion circuit includes an amplifier having a gain of 1 or more and connected between the current-voltage conversion element and the output terminal.

With the above configuration, it is possible to amplify an output potential of the current-voltage conversion element and to supply the output potential to the capacitance feedback line. This way, it is possible to compensate a degradation of the potential of the gate terminal of the driving TFT which degradation is caused by parasitic capacitance of the driving TFT provided on each pixel circuit and of the switching element.

Further, the display device of the present invention may be arranged so that the current supply line is connected to a source terminal of a driving TFT of each of pixel circuits connected to a common data line, the display device further comprising: a storage means to store, for each current supply line, an average value or a total sum of amounts of currents for pixel circuits connected to a common current supply line, the average value or the total sum being calculated based on amounts measured in advance of currents flowing in the driving TFT of said each of pixel circuits when a predetermined potential has been supplied to the gate terminal of the driving TFT; and a correcting means to correct a data potential corresponding to image data which is supplied to each data line corresponding to the current supply line, the correction being carried out, based on the average value or the total sum stored in the storage means, in such a manner as to compensate variations in TFT characteristics of driving TFTs among pixel circuits aligned in an extending direction of the scanning line.

In addition to making it possible to prevent the streaked image defects caused by variations in the TFT characteristics of the driving TFT occurring between pixels aligned in a direction perpendicular to the extending direction of the scanning line, the above configuration also makes it possible to prevent image defects (image display irregularities) caused by variations in the TFT characteristics of the driving TFT occurring between pixels aligned in the extending direction of the scanning line. Further, variations in current for each pixel are reduced, an amount of the reduction corresponding to an amount by which the variations in the TFT characteristics have been compensated for each scanning line. As a result, because it is possible to reduce the number of bits of the memory to memorize a current value for each pixel, it is possible to provide the memory with a storage capacity (as required for the memorizing means) lower than the memory in Patent Literature 2. As a result, it is possible to reduce the manufacturing cost of the display device.

A manufacturing method of the present invention of a display device is a manufacturing method of a display device including the dummy pixel circuit, comprising the steps of: forming each driving TFT via crystallization by laser annealing, the crystallization being conducted by scan processing in which a laser irradiation spot travels alongside the extending direction of the scanning line, the scan processing being sequentially repeated by shifting position of the scan processing in a direction perpendicular to the extending direction of the scanning line; and providing the dummy pixel circuit for each scanning line or for every group of scanning lines each connected to a pixel circuit including the driving TFT in a laser irradiation spot in one scanning processing.

With the above method, the dummy driving TFT and the driving TFT of each pixel circuit connected to the scanning line corresponding to the dummy pixel circuit including the dummy driving TFT are crystallized by one scan processing. Accordingly, it is possible to give, to the dummy driving TFT, TFT characteristics substantially the same as the TFT characteristics of each driving TFT. As a result, it is possible to prevent with higher precision the occurrence, between pixels adjacent in a direction perpendicular to the extending direction of the scanning line, of streaked image defects caused by variations in the TFT characteristics of the driving TFT included in the pixel circuit. Especially, streaked image defects caused by variations in the TFT characteristics of the driving TFT are likely to occur at the junction between laser irradiation spots during two separate scan processings; however, with the above configuration, it is possible to prevent the occurrence of streaked image defects at the junction between laser irradiation spots.

| Reference Signs List | |
|---|---|
| 1, 1b, 1c | display device DSW1, DSW2, DSW3 switching TFT |
| 11 | source driver circuit |
| 12 | control circuit |
| 13 | gate driver circuit |
| 14 | current-voltage conversion circuit |
| 21 | shift resistor |
| 22 | resistor |
| 23 | latch |
| 24 | D/A converter |
| 31 | current latch circuit |
| 41 | power |
| 42 | memory element |
| 43 | computing element |
| Aij | pixel circuit |
| Bi | current output circuit |
| CM | current mirror circuit |
| Cs | capacitor |
| CSW | changeover switch |
| CSi | capacitance feedback line |
| Cgs | parasitic capacitance |
| DrDTFT | current-voltage conversion element |
| EL | organic EL element |
| Ei | changeover signal line, changeover signal |
| FBi | current feedback line |
| Gi | scanning line |
| Mj | current measurement element |
| OA | amplifier |
| Sj | data line |
| VPj | current supply line |
| Vdata | data potential |

DESCRIPTION OF EMBODIMENTS

First Embodiment

The following is an explanation of an embodiment of the present invention. The explanation regarding the present embodiment will focus on a situation in which the present invention is applied to a display device using an organic EL element. However, the present invention is not limited, in terms of possible applications, to such an embodiment, and it is possible to apply the present invention to any display device as long as the display device is a current-controlled display device that is a display device using an element whose luminescent condition varies in line with a current amount. For example, the present invention may be applied to a FED (Field Emission Display).

[1-1. General Configuration of Display Device 1]

Figure 2:
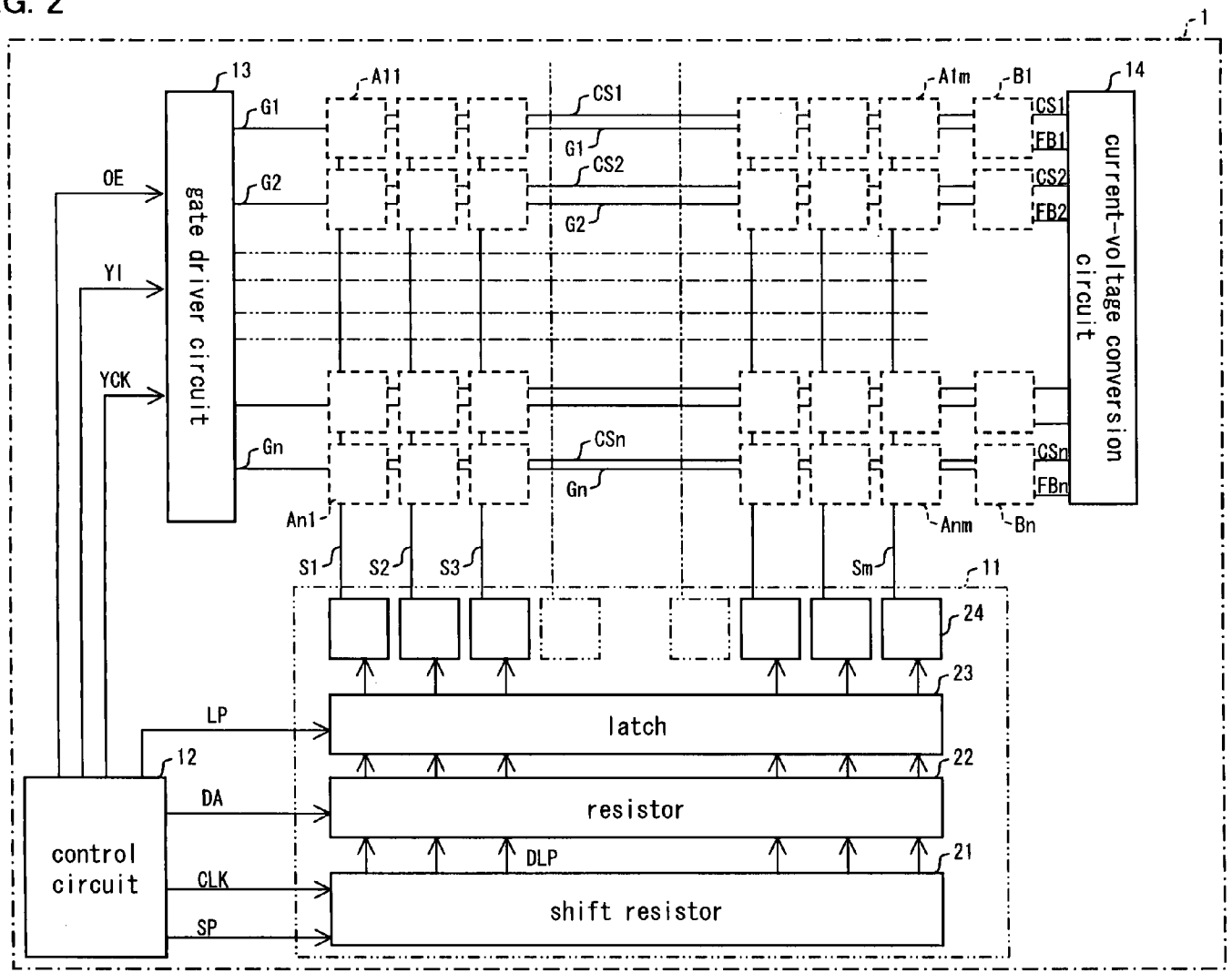
FIG. 2 is an explanatory view illustrating a schematized configuration of a display device in accordance with an embodiment of the present invention.

FIG. 2 is an explanatory view illustrating a configuration of a display device 1 in accordance with the present embodiment. As shown in FIG. 2, the display device 1 includes a plurality of pixel circuits Aij (i being an integer between 1 and n; j being an integer between 1 and m), a plurality of current output circuits (dummy pixel circuits) Bi (i being an integer between 1 and n), a source driver circuit 11, a gate driver circuit 13, a controller circuit 12, and a current-voltage conversion circuit 14.

The pixel circuits Aij are disposed in a matrix configuration so as to correspond to individual intersections between a plurality of data lines Sj, disposed so as to be parallel to each other, and a plurality of scanning lines Gi, disposed so as to be parallel to each other and so as to be perpendicular to the plurality of data lines Sj. Current output circuits Bi are provided for each scanning lines Gi and are disposed outside a display area made from the pixel circuits Aij. The current output circuits Bi feedback to the current-voltage conversion circuit 14 a current corresponding to characteristics of a driving TFT provided on each pixel circuit Ai1 to Aim connected to the scanning lines Gi. The current-voltage conversion circuit 14 is a circuit converting into a voltage the current fed back from the current output circuits Bi. Details regarding the pixel circuits Aij, the current output circuits Bi and the current-voltage conversion circuit 14 will be explained later.

The data lines Sj are signal lines to supply, from the source driver circuit 11, a data signal corresponding to image data to be displayed on the pixel circuits Aij. Further, the scanning lines Gi are signal lines to supply a scanning signal from the gate driver circuit 13 to the pixel circuits Aij.

The source driver circuit 11 includes a m-bit shift resistor 21, a resistor 22, a latch 23, and m D/A capacitor(s) 24.

The shift resistor 21 includes m resistor(s) connected in cascade (not shown). In the shift resistor 21, a start pulse SP inputted into a forefront resistor from the controller circuit 12 is sequentially transferred by each stage of resistors in synchronization with a clock CLK being inputted from the controller circuit 12, and a timing pulse DLP is outputted from each stage of resistors into the resistor 22, in line with a timing of input of the start pulse SP into each stage of resistors.

In the resistor 22, display data DA is inputted from the control circuit 12 in line with a timing of input of the timing pulse DLP. When a line of the display data DA is stored in the register 22, the line of display data DA is inputted into the latch 23 in synchronization with a latch pulse LP being inputted from the controller circuit 12 into the latch 23. Each display data DA retained in the latch 23 is outputted to corresponding one of the D/A capacitors 24.

One D/A capacitor 24 is provided for each of the data lines Sj. The D/A capacitor 24 converts into an analog signal voltage the display data DA inputted from the latch 23, and outputs the analog signal voltage to corresponding one of the data lines Sj.

The gate driver circuit 13 includes a shift resistor circuit (not shown), a logical operation circuit (not shown), and a buffer (not shown).

The shift resistor circuit is made from n resistors connected in cascade. A start pulse YI inputted from the controller circuit 12 into the forefront resistor of the gate driver circuit 13 is sequentially transferred by each stage of resistors in synchronization with a clock YCK being inputted from the controller circuit 12, and is sequentially outputted by each stage of resistors one after another into the logical operation circuit.

The logical operation circuit is provided so as to correspond to each stage of transistors. A logical operation is conducted based on (i) pulses inputted by each stage of resistors; and (ii) a timing signal OE inputted from the control circuit 12. A voltage corresponding to a result of the logical operation is outputted into the scanning lines Gi corresponding to individual stages via the buffers, the buffers being provided so as to correspond to the logical operation circuits of individual stages.

Each of the scanning lines Gi is connected with m pixel circuits (from Ai1 to Aim) and the current output circuit Bi, and the pixel circuits Ai1 to Aim are scanned in a group by each of the scanning lines Gi. This way, a signal voltage is applied onto each of the scanning lines Gi, in accordance with a timing of writing a data potential into each pixel circuit Ai1 to Aim connected to each of the scanning lines Gi, the data potential being supplied from the source driver circuit 11 via each data line.

As above, the source driver circuit 11 is a line-sequential scanning circuit which sends, in one time, data to the pixel circuits on one scanning line. However, a configuration of the source driver circuit 11 is not limited to the above, and the source driver circuit 11 may be a point-sequential scanning circuit which sequentially sends data to pixel circuits, one pixel circuit at a time. In case of a point-sequential scanning circuit, during a selection of a scanning line, a voltage of the data lines Sj is retained by a capacitor of the data line. Detailed explanations on the point-sequential scanning circuit will be omitted here.

The controller circuit 12 outputs the start pulse SP, the clock CLK, the display data DA and the latch pulse LP into the source driver circuit 11, and outputs the timing signal OE, the start pulse Y1 and the clock YCK into the gate driver circuit 13.

[1-2. Configurations of the Pixel Circuit, the Current Output Circuit and the Current-Voltage Conversion Circuit]

Figure 1:
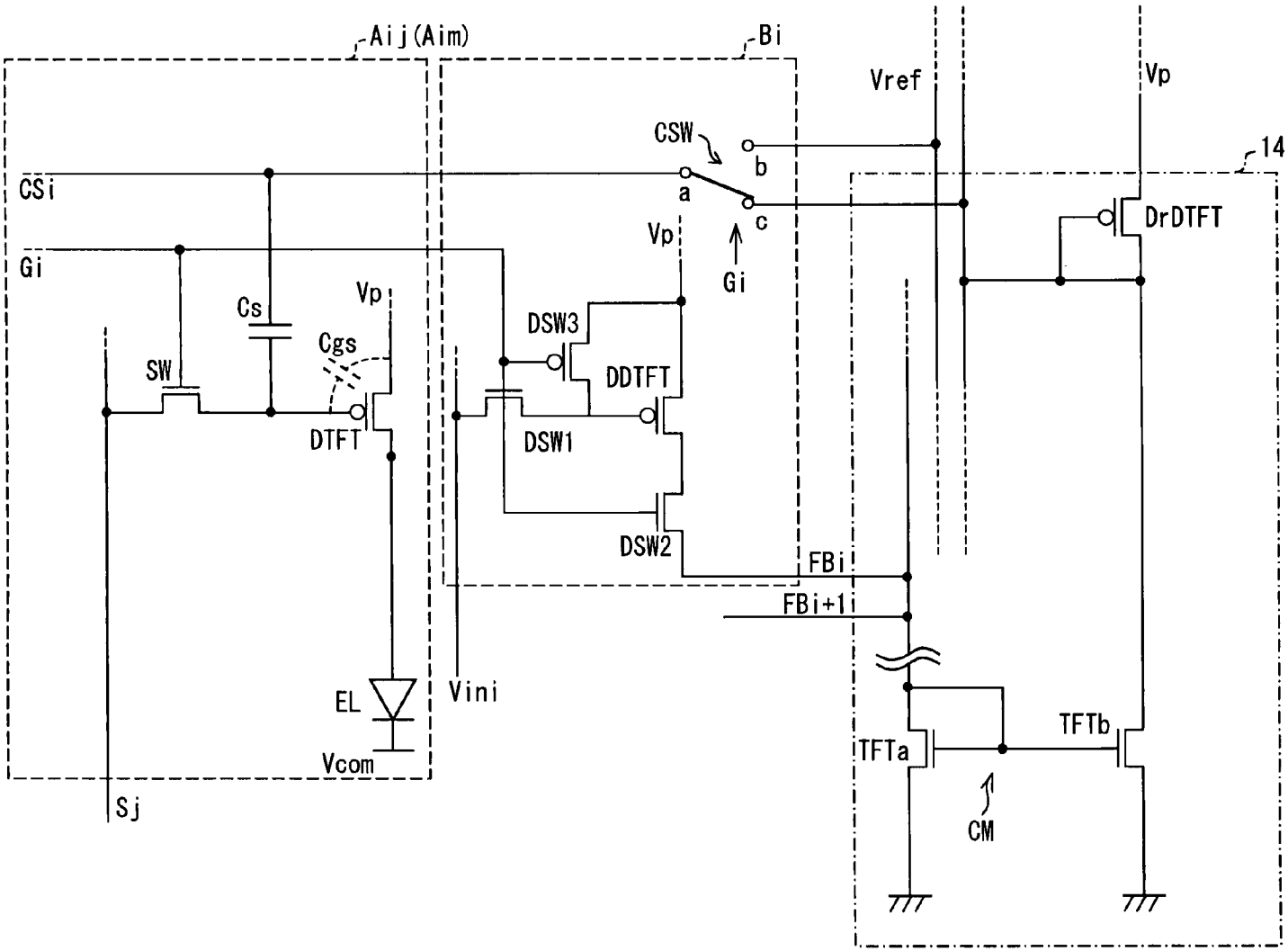
FIG. 1 is a circuit diagram illustrating a configuration of a pixel circuit, a current output circuit and a current-voltage conversion circuit included in a display device illustrated in FIG. 2.

Next is an explanation of a configuration of the pixel circuits Aij, of the current output circuits Bi and of the current-voltage conversion circuit 14 included in the display device 1. FIG. 1 is a circuit diagram illustrating configurations of the pixel circuits Aij, of the current output circuit Bi and of the current-voltage conversion circuit 14. It must be noted that, regarding the pixel circuits Aij, the current output circuits Bi and the current-voltage conversion circuit 14, only parts corresponding to one of the scanning lines Gi are shown in FIG. 1.

As shown in FIG. 1, each of the pixel circuits Aij includes the driving TFT (DTFT), the switching TFT (SW), the capacitor (retention capacitor) Cs, and the organic EL element EL. It must be noted that, among the pixel circuits Ai1 to Aim corresponding to the scanning line Gi, FIG. 1 shows only the pixel circuit Aim adjacent to the current output circuit Bi (i.e. the pixel circuit Aim which is farthest from the scanning driver circuit 13); however, the other pixel circuits Ai1 to Aim-1 have a similar configuration. Further, it is possible to use a variety of conventionally-known organic EL elements as the organic EL element.

The current output circuit Bi includes the dummy driving TFT (DDTFT), the switching TFTs (DSW1, DSW2, DSW3) and the changeover switch CSW. In the present embodiment, the changeover switch CSW is provided in the current output circuit Bi; however, there is no limitation in this regard, and the changeover switch CSW may be provided on the current-voltage conversion circuit 14, or independently between the current output circuit Bi and the current-voltage conversion circuit 14.

Further, the pixel circuits Aij and the current output circuits Bi are formed on the same glass substrate. An area in which the pixel circuits Aij are formed is called a display area; the current output circuits Bi are provided outside the display area. Further, regarding the pixel circuits and the current output circuit provided on the same scanning line, a manufacturing process of the DTFTs provided on the pixel circuits and a manufacturing process of the DDTFTs provided on the current output circuit include a crystallization process by laser annealing during the same laser scan (one laser scan). Specifically, a main scanning direction (a traveling direction of a laser spot each time a laser scan is conducted; a long direction) is parallel to a direction in which the scanning lines Gi extend. The DTFTs of the pixel circuits and the DDTFT of the current output circuit that are provided on the common scanning line are crystallized during the same laser scan. Further, each of the DTFTs and the DDTFT are formed so as to have the same shape (aspect ratio) and the same dimensions. As a result, the DTFTs provided on the pixel circuits Ai1 to Aim on the scanning lines Gi and the DDTFT provided on the current output circuit Bi on the scanning lines Gi have substantially the same characteristics (driving ability), such as threshold value (threshold voltage) and mobility.

The current-voltage conversion circuit 14 includes a current mirror circuit CM and a DrDTFT, that is a current-voltage conversion element connected to a diode. It is not necessary to provide the current-voltage conversion circuit 14 for each of the pixel circuits Aij; instead, it is sufficient to provide at least one current-voltage conversion circuit 14 for all pixel circuits Aij.

With the present embodiment, a low-temperature polysilicon TFT, a CG (Continuous Grain) silicon TFT or an amorphous silicon TFT are used as each of the TFTs (switching element) provided on the pixel circuits Aij, the current output circuits Bi and the current-voltage conversion circuit 14. Because configurations and manufacturing processes of the above TFTs are well-known, explanations thereof will be omitted in the present embodiment. It must be noted that each of the TFTs is not limited to the above configuration, and other TFTs may be used as well.

Further, in the present embodiment, N-channel-type TFTs were used as the SW (switching TFT) provided on the pixel circuits Aij, as the DSW1, DSW2 (switching TFT) provided on the current output circuits Bi, and as TFTa and TFTb provided on the current mirror circuit CM provided on the current-voltage conversion circuit 14. Further, P-channel TFTs were used as the DTFT (driving TFT) provided on the pixel circuits Aij, as the DDTFT (dummy driving TFT) and the DSW3 (switching TFT) provided on the current output circuits Bi, and as the DrDTFT (current-voltage conversion element) provided on the current-voltage conversion circuit 14. However, each of the TFTs is not limited to the above configuration, and any configuration making it possible to achieve an operation similar to those of the circuits in the present embodiment may be used.

A source terminal of the DrDTFT provided on the current-voltage conversion circuit 14 is connected to a line supplying a power supply potential Vp. Further, a drain terminal of the DrDTFT is connected to a source terminal of a TFTb included in the current mirror circuit CM, to a gate terminal of the DrDTFT itself, and to a terminal c of the changeover switch CSW provided on the current output circuits Bi.

The current mirror circuit CM includes two TFTs (TFTa and TFTb). As mentioned above, the source terminal of the TFTb is connected to the drain terminal of the DrDTFT. A drain terminal of the TFTb is connected to the GND (common cathode). Further, a gate terminal of the TFTb is connected to a gate terminal of the TFTa. Further, a drain terminal of the TFTa is connected to the GND, and a source terminal of the TFTa is connected via the current feedback lines FB1 to DBn to a drain terminal of the DSW2 provided on each of the current output circuits Bi.

A terminal a of the changeover switch CSW provided on the current output circuits Bi is connected to one end of the capacitor Cs in each of the pixel circuits Ai1 to Aim connected to the scanning lines Gi, via the capacitance feedback lines CSi. Further, the terminal b of the changeover switch CSW is connected to the gate terminal and the drain terminal of the DrDTFT provided on the current-voltage conversion circuit 14. The terminal c of the changeover switch CSW is connected to a line supplying a fixed potential Vref. The fixed potential Vref is generated by a Vref generating section (not shown) provided on the display device 1, based on the power supply voltage etc. Then, the changeover switch CSW switches between a condition in which the terminal a and the terminal b are connected and a condition in which the terminal a and the terminal c are connected, in line with a voltage supplied to the scanning lines Gi. Specifically, in case where a control signal Gi supplied to the scanning lines Gi is L (i.e. low-level), the terminal a and the terminal c become connected; further, in case where the control signal Gi is H (i.e. high-level), the terminal a and the terminal b become connected.

The source terminal of the DDTFT provided on the current output circuits Bi is connected to the terminal supplying the power supply potential Vp and to a source terminal of the DSW3. Further, a drain terminal of the DDTFT is connected to the source terminal of the DSW2. Further, a gate terminal of the DDTFT is connected to a drain terminal of the DSW3 and to a source terminal of the DSW1.

The gate terminals of the DSW1, DSW2 and DSW3 are all connected to the scanning lines Gi. Further, the drain terminal of the DSW1 is connected to the line supplying a dummy data potential Vini driving the DDTFT. The dummy data potential Vini is preferably set to a potential corresponding to a half-tone data potential applied on the pixel circuits Aij. Further, the dummy data potential Vini may be generated by the source driver circuit 11, or by another circuit not shown on the drawings.

The source terminal of the DTFT provided on the pixel circuits Aij is connected to a line (current supply line VPi) supplying the power supply potential Vp. Further, the drain terminal of the DTFT is connected to the GND via the organic EL element EL. Further, the gate terminal of the DTFT is connected to the other end of the capacitor Cs and to the drain terminal of the SW. Further, as described above, the one end of the capacitor Cs is connected to the terminal a of the changeover switch CSW provided on the current output circuits Bi.

The source terminal of the SW is connected to the data lines Sj, and the gate terminal of the SW is connected to the scanning lines Gi.

[1-3. Operations of the Pixel Circuit, the Current Output Circuit, and the Current-Voltage Conversion Circuit]

Figure 3:
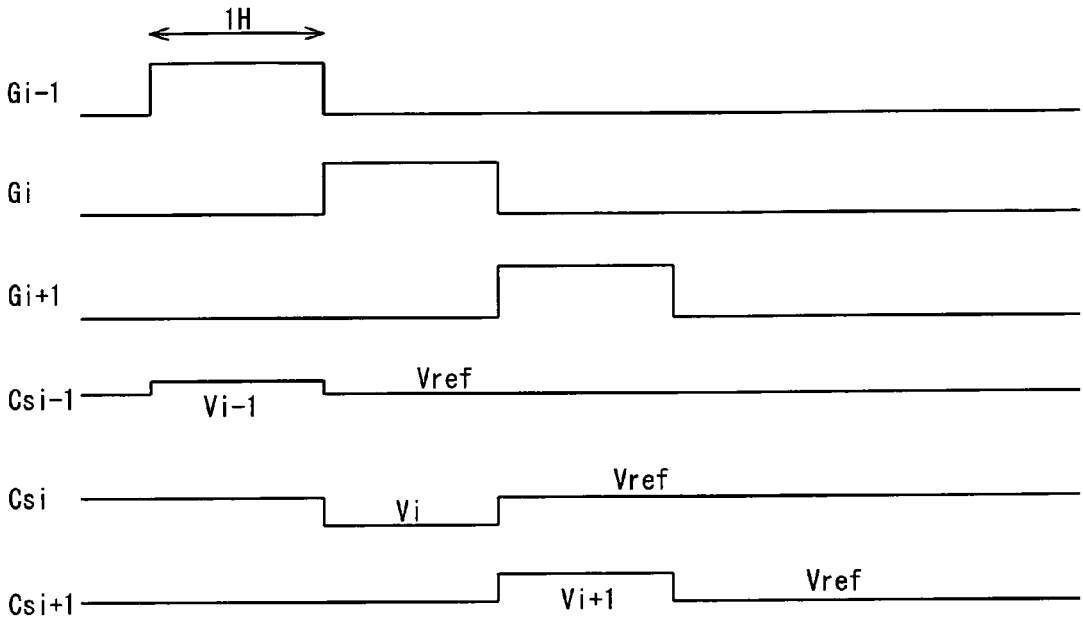
FIG. 3 is a timing chart illustrating an operation timing of the pixel circuit, the current output circuit and the current-voltage conversion circuit illustrated in FIG. 1.

Next is an explanation of an operation of the pixel circuits Aij, of the current output circuits Bi, and of the current-voltage conversion circuit 14 that are included in the display device 1. FIG. 3 is a timing chart illustrating the operation of the pixel circuits Aij, of the current output circuits Bi, and of the current-voltage conversion circuit 14. In FIG. 3, timing of signal changes of scanning lines Gi−1, Gi, Gi+1, and of volume feedback lines CSi−1, CSi, CSi+1 are illustrated.

The signals of the scanning lines Gi−1, Gi, Gi+1 and the signals of the capacitance feedback lines CSi−1, CSi, CSi+1 illustrated on FIG. 3 are signals for the pixel circuits A(i−1)j, Aij and A(i+1)j (connected to the same data line Sj), respectively. Further, the signal of the scanning line Gi−1 and the signal of the capacitance feedback line CSi−1 are for the pixel circuit A(i−1)j connected to the scanning line Gi−1 which is scanned before the scanning line Gi. The signal of the scanning line Gi+1 and the signal of the capacitance feedback line CSi+1 are for the pixel circuit A(i+1)j connected to the scanning line Gi+1 which is next to be scanned after the scanning line Gi.

First, a signal supplied to the scanning line Gi is shifted to H. This way, the SW of the pixel circuit Aij becomes conductive, and the data potential Vdata supplied to a line Sj is supplied to the gate terminal of the DTFT and to the one end of the capacitor Cs. Further, because the scanning line Gi has been shifted to H, the DSW1 and DSW2 of the current output circuit Bi become conductive, and DSW3 becomes cutoff. Further, the changeover switch CSW is caused to switch so that the capacitance feedback line CSi is connected to an output side of the DrDTFT. This way, the potential of the gate terminal of the DDTFT becomes a dummy data potential Vini. A current in line with a conductance of the DDTFT (TFT characteristics of the DDTFT) is fed back to the current-voltage conversion circuit via the current feedback line FBi. A current whose amount is the same with the current fed back to the current-voltage conversion circuit 14 is flown into the DrDTFT by the current mirror circuit CM, converted into a voltage by the DrDTFT, and changes a potential of the other end of the capacitor CS via the capacitance feedback line CSi. A changed amount of potential in the other end of the capacitor CS is equal to an amount depending on TFT characteristics of the DDTFT provided on the current output circuit Bi. It must be noted that a potential in the other end of the capacitor Cs after the change is $V_{CSi}$.

This way, the potential in line with the data potential Vdata supplied by the data line Sj is written into the gate terminal of the DTFT and to the one end of the capacitor Cs, and at the same time the TFT characteristics of the DDTFT are detected and a potential in accordance with the TFT characteristics of the DDTFT is written into the other end of the capacitor Cs.

Subsequently, when the selection period of the scanning line Gi comes to an end and the scanning line Gi is shifted to L, a feedback of a current intermediated by the current feedback line FBi from the current output circuit Bi to the current-voltage conversion circuit 14 is cutoff, and at the same time the changeover switch CSW is caused to switch so that the capacitance feedback line CSi is connected to the line supplying the fixed potential Vref. As a result, the gate potential of the DTFT shifts (changes) by only a value corresponding to $V_{CSi}$−Vref. This way, variations in the TFT characteristics of the DTFT are compensated.

The following is an explanation of a reason why the above-described operation compensates the variation in the TFT characteristics of the DTFT.

In general, in a saturation area of a TFT, a current EL flowing between a drain and a source of the TFT, when a voltage between the gate and the source is Vgs and when disregarding channel length modulation effect, can be represented as follows:

$$I_{EL}=\tfrac{1}{2}\cdot W/L\cdot Cox\cdot\mu(Vgs-Vth)^2 \quad (1)$$

where W/L is an aspect ratio of the TFT; Cox is a gate capacitance of the TFT; μ is a mobility of the TFT; Vth is a threshold value (threshold voltage) of the TFT. Accordingly, the current $I_{EL}$ flowing between the drain and the source of the DTFT depends on the threshold value of the DTFT.

Here, in case where a signal voltage Vgs applied between the gate and the source is set beforehand to a voltage obtained by adding an offset of Vth to the data potential Vdata (that is, in case where Vgs=Vdata+Vth), the current $I_{EL}$ can be represented as follows:

$$I_{EL}=\tfrac{1}{2}W/L\cdot Cox\cdot\mu(V\text{data})^2 \quad (2)$$

Accordingly, the current $I_{EL}$ flowing between the drain and the source is not affected by variations of the threshold value Vth. It must be noted that the equation (1) may be applied to the DDTFT as well. Further, as mentioned above, the threshold value Vth of the DTFT and the threshold value Vth of the DDTFT have substantially the same value.

As described above, when the scanning line Gi is shifted to H, a current flowing in the DDTFT is fed back to the current-voltage conversion circuit 14 via the current feedback line FBi. A current of the same amount as that of such fed back current is flown into the DrDTFT by the current mirror circuit CM. At this point, a voltage VgsDr applied across both ends of the diode-connected DrDTFT becomes as below:

$$VgsDr=\left|\sqrt{\frac{I_{EL}}{\frac{1}{2}\mu_n\mathrm{Cox}\frac{W_D}{L_D}}}+VthDr\right| \quad \text{Equation 1}$$

where EL is a current flowing between the drain and the source of the DrTFT; $\mu_n$ is the mobility of the DrTFT; Cox is the gate capacitance of the DrTFT; $W_D/L_D$ is the aspect ratio of the DrTFT; VthDr is the threshold value of the DrDTFT.

Here, in a case where the aspect ratio of the DrTFT and the aspect ratio of the DDTFT are identical, the following relation is met:

$$VgsDr=VgsD-VthD+VthDr$$

Accordingly, during the selection period, the potential $V_{CSi}$ of the capacitance feedback line CSi is as follows:

$$V_{CSi}=Vp-VgsDr=Vp-VgsD+VthD-VthDr$$

Here, because, the gate potential of the DDTFT is, during the selection period (i.e. the period in which the scanning line Gi are shifted to H), a dummy data potential Vini, the following relation is met:

$$Vini=Vp-VgsD$$

Accordingly, the following relation is met:

$$V_{CSi}=Vini+VthD-VthDr$$

Further, during the selection period, a data potential Vdata supplied to the data line Sj is written into the gate terminal of the DTFT.

Subsequently, the selection period having come to an end (i.e. the scanning line Gi having been shifted to L), and the potential of the capacitance feedback line CSi having changed to a fixed potential Vref, the gate potential Vg of the DTFT is ideally as follows:

$$Vg=V\text{data}+Vini+VthD-VthDr-Vref$$

$$I_{EL}=k\cdot(V\text{data}+Vini+VthD-VthDr-Vref-Vth)^2 \quad (3)$$

Thus, because the threshold value Vth of the DTFT and the threshold value VthD of the DDTFT are equal, the following relation is met:

$$I_{EL}=k\cdot(V\text{data}+Vini-VthDr-Vref)^2$$

Accordingly, it is possible to compensate the variations in the threshold value Vth (TFT characteristics) of the DTFT provided on each of the pixel circuits Aij. In other words, regarding individual lines of a display screen (individual scanning lines), it is possible to compensate the variations in the TFT characteristics of the DTFT between such lines, and it is possible to prevent the occurrence of streaked image defects caused by variations in the TFT characteristics of the DTFT.

As shown above, the display device 1 in accordance with the present embodiment includes, for each of the scanning lines Gi, a DDTFT (dummy driving TFT) having TFT characteristics substantially to the same as the TFT characteristics of the DTFT provided on the pixel circuits Aij connected to that scanning line Gi. In addition, a current flowing in the DDTFT when the dummy data potential Vini is supplied to the gate terminal of the DDTFT is fed back to the current-voltage conversion circuit 14; based on a result of a conversion of the current into a voltage, the gate potential of the DTFT of each of the pixel circuits Aij is controlled.

This way, because it is possible to compensate the variations in TFT characteristics of the DTFT for each of the scanning lines Gi, it is possible to prevent the occurrence of streaked pixel defects caused by variations in the TFT characteristics of the DTFT.

Further, compared to a conventional correction pixel circuit (i.e. conventional pixel circuits having a function of compensating variations), it is possible to achieve a pixel circuit with a simpler configuration, allowing downsizing of a circuit scale. Further, because it is possible to dispose the current output circuit Bi and the current-voltage conversion circuit 14 outside the display area, it is possible to increase the open area ratio of a pixel compared to a display device including a conventional correcting pixel circuit.

Further, the current-voltage conversion circuit 14 can be realized by a simple configuration using the current mirror circuit CM and the current-voltage conversion element DrDTFT. Further, it is sufficient to provide only one current-voltage conversion circuit 14 for all pixel circuits Aij. As a result, it is possible to minimize an increase in the scale of the external circuit. However, there is no limitation regarding the number of the current-voltage conversion circuit 14.

Further, in the present embodiment, because it is sufficient to provide one current output circuit Bi for each of the scanning lines Gi, it is possible to limit the increase in the circuit scale of the external circuit. It must be noted that the current output circuit Bi is provided for each of the scanning lines Gi in the present embodiment; however, there is no limitation in this regard, and one current output circuit Bi may for example be provided for several scanning lines Gi. However, it is preferable that the changeover switch CSW be provided for each scanning line.

Further, in the present embodiment, regarding each of the pixel circuits Aij and the current output circuit Bi that are connected to the same scanning line, the DTFT of each of the pixel circuits Aij and the DDTFT of the current output circuit Bi were subjected to a crystallization process through laser annealing by the same laser scan, and their shapes and sizes are identical. As a result, the DTFT and the DDTFT corresponding to the same scanning line Gi have substantially the same driving functions such as a threshold value and mobility. Accordingly, by controlling the gate potential of the DTFT of the pixel circuit Aij connected to the scanning line Gi to which the current output circuit Bi including the DDTFT in accordance with a current flowing the DDTFT, it is possible to compensate with high precision variations in threshold value characteristics of the DTFT in a sub-scanning direction (i.e. extending direction of the data line Sj). Further, it is possible to compensate with high precision the variations in threshold value characteristics of the DTFT at a joint of laser-scanned areas.

It must be noted that, in a case where a width of the laser annealing (i.e. a width of the sub-scanning direction in one laser scan) is wider than the width of the sub-scanning direction of each of the pixel circuits Aij, one current output circuit may be provided for each group of scanning lines included in the width of the laser annealing. In such a case, the TFT characteristics of the DTFTs of the pixel circuits corresponding to the scanning lines included in a scanned area of one laser scan, on one hand, and the TFT characteristics of the DDTFTs of current output circuits included in the scanned area of one laser scan, on the other hand, are substantially the same. Accordingly, it is possible to compensate with high precision variations in threshold value characteristics of the DTFT in the sub-scanning direction (i.e. the direction in which the data line Sj extends), especially variations in threshold value characteristics of the DTFT at the joint of laser-scanned areas.

Further, in the present embodiment, as described above, after the selection period of the scanning line Gi, gate potentials of the DTFTs provided on the pixel circuits Ai1 to Aim connected to the scanning line Gi are changed in line with respective driving abilities (threshold values) of the DTFTs. However, in some cases, a changed amount of the gate potential is attenuated by the capacitor Cs and by a parasitic capacitance Cgs of the DTFT (see FIG. 1).

Figure 4:
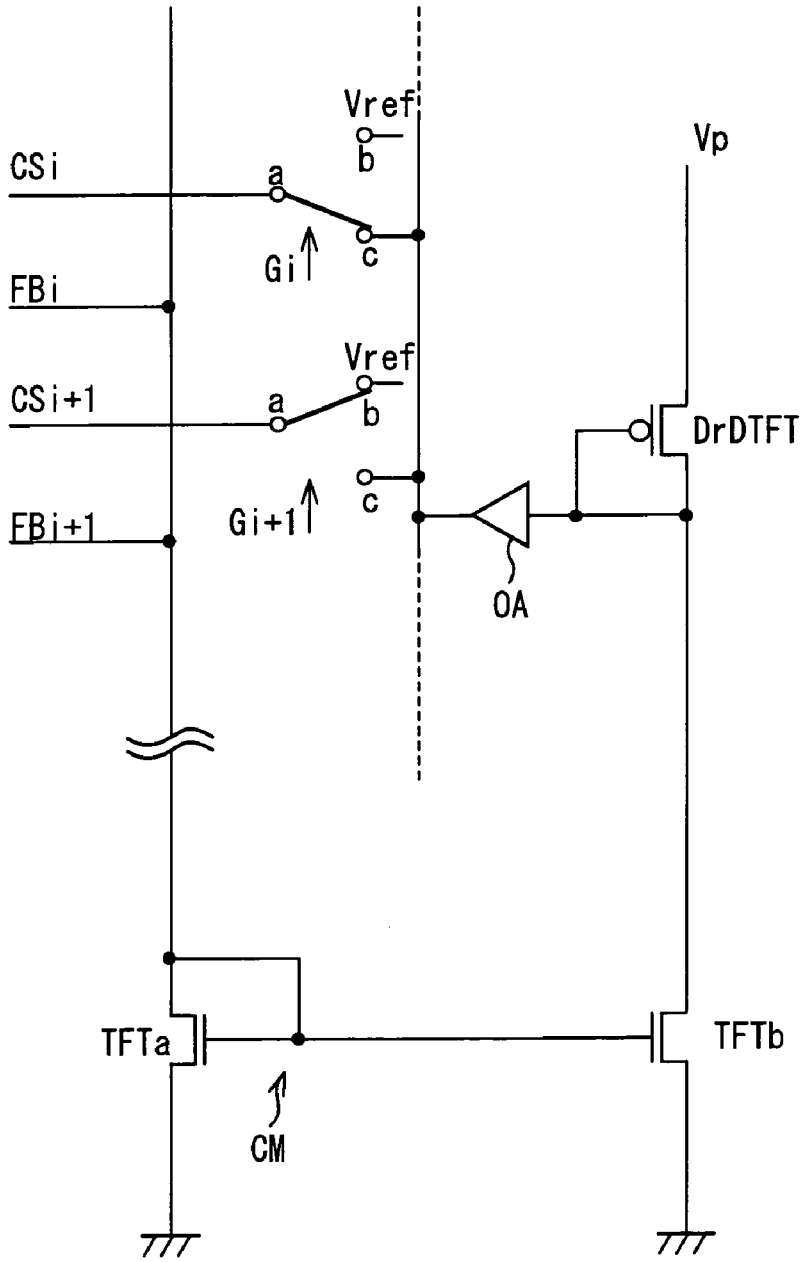
FIG. 4 is a circuit diagram illustrating an example of the current-voltage conversion circuit illustrated in FIG. 1.

As shown on FIG. 4, in order to compensate the attenuation of the changed amount of the gate potential, an amplifier (buffer amplifier) OA may be provided on an output side of the DrDTFT (gate terminal of the DrDTFT) provided on the current-voltage conversion circuit 14 and a gain Av of the amplifier OA may be set to 1 or more. It must be noted that the gain Av of the amplifier OA is preferably set so that Av=Cs+Cgs/Cs, where Cs is an amount of the capacitor Cs and Cgs is an amount of the parasitic capacitance of the DTFT. This allows compensating the attenuation of the changed amount due to coupling. Further, by outputting the output signal from the DrDTFT via the amplifier OA, it is possible to cause the capacitance feedback lines CSi to have low output impedance, thereby increasing the driving ability of the capacitance feedback lines CSi.

Second Embodiment

The following is an explanation of another embodiment of the present invention. For the sake of an easy explanation, members operating in the same way as in First Embodiment are given the same reference numerals, and explanations thereof will be omitted.

In the First Embodiment as described above, the current output circuits (dummy pixels) Bi are provided next to the display area (effective display area) constituted by the pixel circuits Aij, and the gate potentials of respective DTFTs (driving TFT) on the pixel circuits Aij are controlled, based on the feedback currents supplied from the current output circuits Bi to the current-voltage conversion circuit 14. On the other hand, in the present embodiment, no current output circuit Bi is provided, and gate potentials of respective DTFTs on the pixel circuits Aij are controlled, based on feedback currents fed back from pixel circuits Aij to a current-voltage conversion circuit 14.

Figure 5:
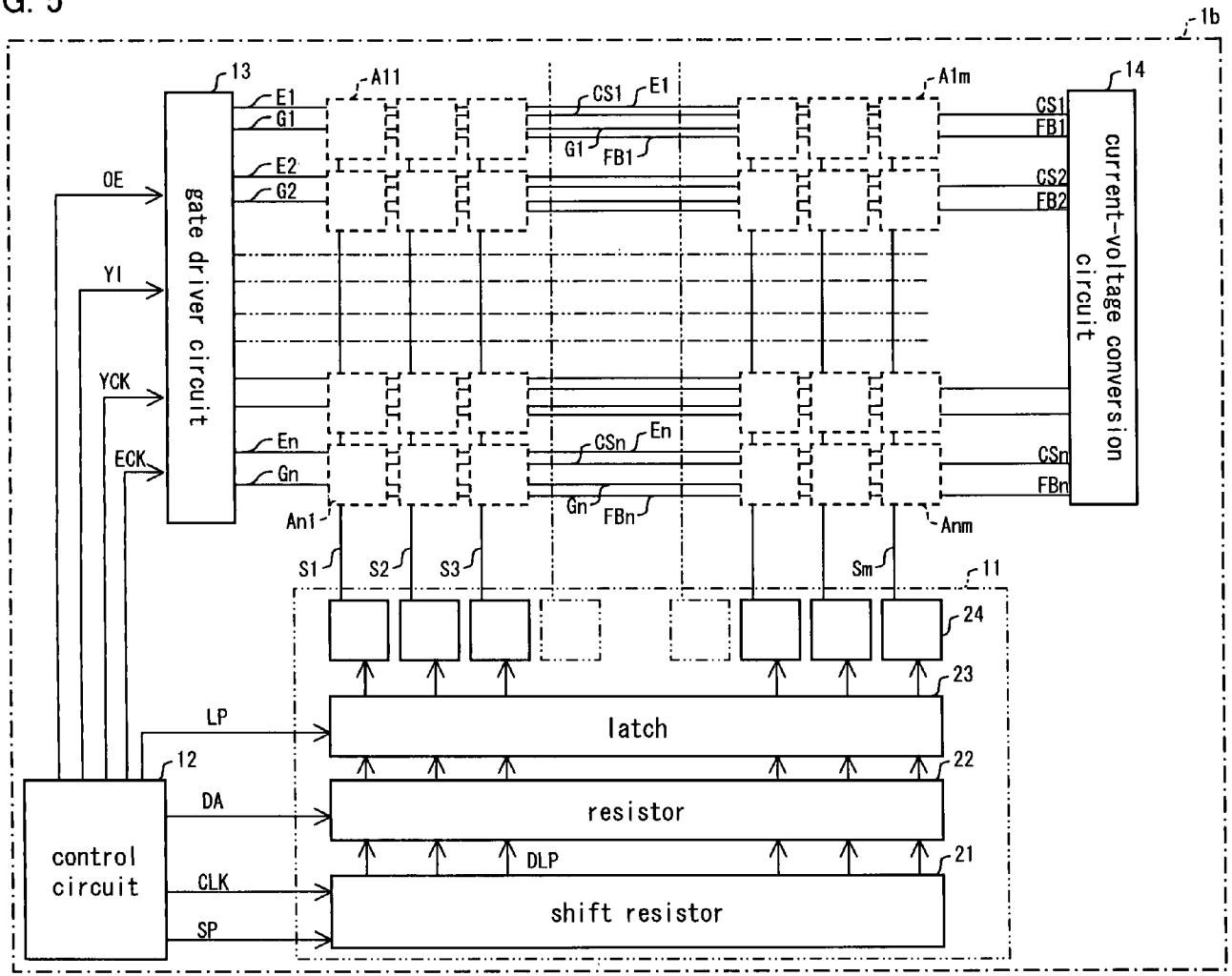
FIG. 5 is an explanatory view illustrating a schematized configuration of a display device in accordance with another embodiment of the present invention.

FIG. 5 is an explanatory view schematically illustrating a configuration of a display device 1*b* in accordance with the present embodiment. As shown on FIG. 5, the display device 1*b* differs in that (i) no current output circuit (dummy pixel) Bi is provided; (ii) a current feedback line FBi to the current-voltage conversion circuit 14 is provided in such a manner as to connect the pixel circuits Ai1 to Aim provided on the same scanning line Gi to the current-voltage conversion circuit 14; and (iii) a changeover signal line Ei is provided, via which a changeover signal Ei is supplied from a gate driver circuit 13 to each of the pixel circuits Ai1 to Aim corresponding to the same scanning line Gi. Details regarding the changeover signal Ei will be explained later.

Figure 6:
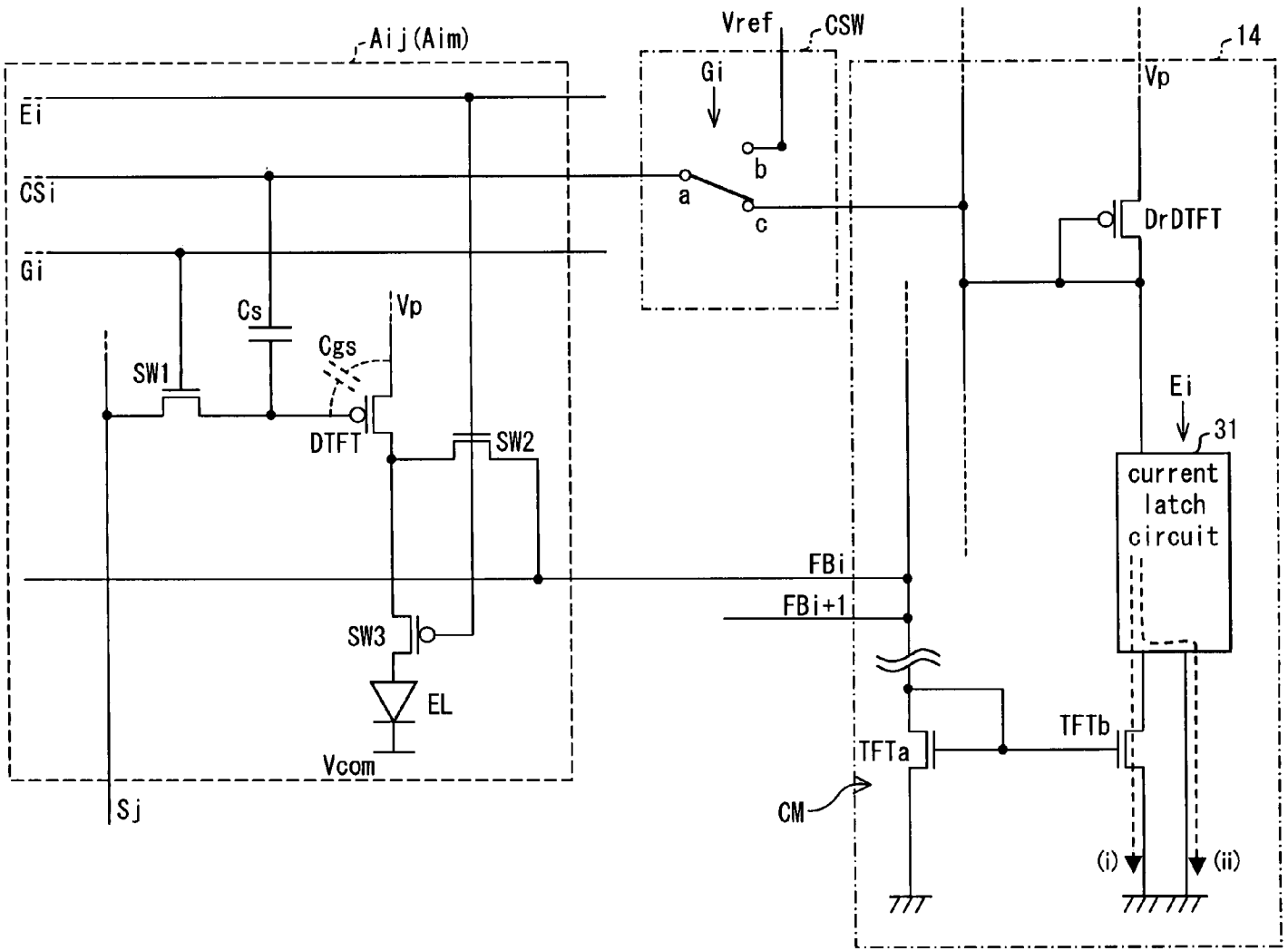
FIG. 6 is a circuit diagram illustrating a configuration of a pixel circuit and a current-voltage conversion circuit included in a display device illustrated in FIG. 5.

FIG. 6 is a circuit diagram illustrating configurations of a pixel circuit Aij and of the current-voltage conversion circuit 14 in the display device 1*b*.

As shown on FIG. 6, the pixel circuit Aij, which has the same configuration as a pixel circuit Aij in the display device 1 of First Embodiment, further includes switching TFTs SW2 and SW3. In the present embodiment, the SW2 is an N-channel-type TFT, and the SW3 is a P-channel TFT.

The SW2 includes a source terminal connected to a drain terminal of a DTFT, a drain terminal connected to a current feedback line FBi, and a gate terminal connected to a changeover signal line Ei. The SW3 includes a source terminal connected to the drain terminal of the DTFT, a drain terminal connected to an organic EL element EL, and a gate terminal connected to the changeover signal line Ei.

The changeover signal line Ei is connected to the gate driver circuit 13, via which changeover signal line Ei a changeover signal Ei is supplied from the gate driver circuit 13 to the pixel circuits Aij connected to the scanning signal line Gi, the changeover signal Ei being a signal for dividing a selection period of the scanning line Gi into a first half and a second half of the selection period. As in the case with a Gi, the changeover signal Ei is generated by the gate driver circuit 13 based on a signal supplied from a control circuit 12 to the gate driver circuit 13. Specifically, this can be carried out by a method which, for example, includes steps of: supplying, from the control circuit 12 to the gate driver circuit 13, a gated-clock ECK having the same cycle as the clock YCK; calculating logical multiplication of the control signal Gi and the gated-clock ECK; and creating the changeover signal Ei, based on the logical multiplication. According to the above method, the changeover signal Ei has the same signal width (cycle) as the gated-clock ECK. It must be noted that the first half of the period is not necessarily the same in length as the second half thereof.

The current-voltage conversion circuit 14, which has the same configuration as the current-voltage conversion circuit 14 in the display device 1 of First Embodiment, further includes a current latch circuit 31. Details regarding the current latch circuit 31 will be explained later. It must be noted that in the present embodiment, which differs from First Embodiment in that the current-voltage conversion circuit 14 is supplied with the feedback current from the pixel circuits Aij connected with the scanning line Gi, it may be configured such that (i) an area ratio of a current mirror circuit CM is set as appropriate, and (ii) dimensions of a DrDTFT are set as appropriate. For example, in a case where m current output circuits are provided for each scanning line, the DrDTFT can have the same aspect ratio as that of the DTFT and the current mirror CM can have an area ratio such that TFTa:TFTb=m:1.

Figure 7:
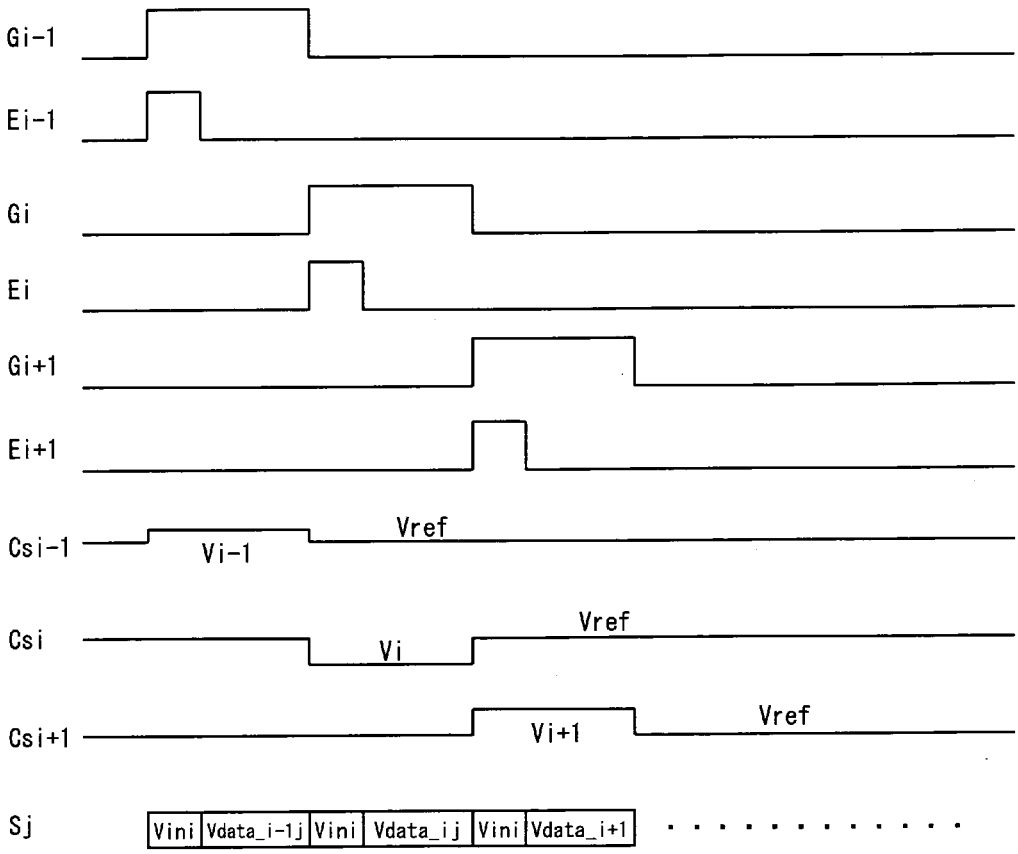
FIG. 7 is a timing chart illustrating an operation timing of the pixel circuit, the current output circuit and the current-voltage conversion circuit illustrated in FIG. 6.

FIG. 7 is a timing chart indicating operation timings of pixel circuits Aij and the current-voltage conversion circuit 14 in the display device 1*b*.

First, a signal to be supplied to the scanning signal line Gi is shifted to H, and the changeover signal Ei to be supplied to the changeover signal line Ei is shifted to H. By this, (i) SW1 on a pixel circuit Aij is electrically conducted so that a data potential Vdata supplied to a data line Sj is impressed into the gate terminal of the DTFT and one terminal of a capacitor Cs; (ii) the SW2 is electrically conducted; and (iii) the SW3 is electrically blocked. As such, a current, which is determined based on a conductance (TFT characteristics) of the DTFT, is fed back to the current-voltage conversion circuit 14 via the current feedback line FBi. Consequently, in the current-voltage conversion circuit 14, the current mirror circuit CM supplies the current latch circuit 31 with a current having the same current amount as the current thus fed back to the current-voltage conversion circuit 14. The current latch circuit 31 latches the current thus supplied, and then supplies it to the DrDTFT. Then, the DrDTFT converts the current into a voltage, which is then, as in the case with the First Embodiment, applied via a capacitance feedback line Csi to the other terminal of the capacitor Cs. By this, an electric potential of the second terminal of the capacitor Cs is changed to an electric potential $V_{CSi}$. In this case, the electric potential of the other terminal of the capacitor Cs is changed by a degree determined based on an average of threshold values (TFT characteristics) of respective DTFTs on the pixel circuits Ai1 to Aim. It must be noted that during the first half of the period, a dummy data potential Vini is supplied to the data line Sj. It is preferable that the dummy potential Vini be set to a potential corresponding to a data potential that causes the pixel circuit Aij to exhibit a halftone.

Subsequently, the changeover signal Ei is shifted to L so that the first half of the period is switched to the second half thereof. When the changeover signal Ei is shifted to L, (i) the SW2 is electrically cut off; (ii) the SW3 is electrically conducted; and (iii) the current latch circuit 31 on the current-voltage conversion circuit 14 is caused to operate in the other way, so as to supply the DrDTFT with the current having been latched by the current latch circuit 31. In the DrDTFT, the current is converted into a voltage. It must be noted that a potential of the capacitance feedback line CSi during the second half of the period is the same as the potential of the capacitance feedback line CSi during the first half of the period, because the current latch circuit 31 operates to latch the current that has been fed back to the current-voltage conversion circuit 14 via the current feedback line FBi during the first half of the period. During the second half of the period, a data potential Vdata corresponding to image data is supplied to the data line Sj.

Thus, a potential, which corresponds to the data potential Vdata supplied to the data line Sj, is supplied to the gate terminal of the DTFT and the one terminal of the capacitor Cs. Subsequently, TFT characteristics of the DTFT are measured, and a potential corresponding to a threshold value of the TFT characteristics of the DTFT is supplied into the other terminal of the capacitor Cs.

Thereafter, when the period during which the scanning line Gi is selected ends and the signal supplied to the scanning line Gi is shifted to L, the feedback of the current from the pixel circuits Ai1 to Aim to the current-voltage conversion circuit 14 via the current feedback line FBi is blocked, causing a changeover switch CSW to be switched over so as to connect the capacitance feedback line CSi to a line via which a fixed voltage Vref is supplied. Thus, as in the case with First Embodiment, a gate potential of the DTFT is shifted by $V_{CSi}$−Vref only. Therefore, it is possible to compensate variations in the TFT characteristics of the DTFT.

As explained so far, in the display device 1 of the present embodiment, currents having been determined based on conductances of respective DFTTs on pixel circuits Ai1 to Aim connected with the same scanning line Gi are fed back from the pixel circuits Ai1 to Aim to the current-voltage conversion circuit 14, so that the gate potentials of the DTFTs are controlled based on the currents thus fed back. This makes it possible to control driving voltages that drive the respective DTFTs, based on an average of the currents determined based on the conductances of the respective DTFTs. Therefore, it is possible to compensate, with higher accuracy, a deterioration in image quality that occurs due to variations in the TFT characteristics among the DTFTs on individual pixel circuits.

As is the case with an example shown on FIG. 4, it can be alternatively configured such that an amplifier OA, which may be set to have a gain Av of 1 or more, is provided to an output side (gate terminal) of the DrDTFT on the current-conversion circuit 14.

Further, in the present embodiment in which the current feedback line FBi is connected to each of the pixel circuits Ai1 to Aim connected with the same scanning line Gi, it is configured so as to compensate variations in the TFT characteristics of respective DTFTs, based on the average value of the currents having been determined based on the conductances of the respective DTFTs on the pixel circuits Ai1 to Aim. However, the present invention is not limited to this.

As explained in First Embodiment, in the manufacturing process of DTFTs of pixel circuits Aij connected to the same scanning line Gi, the crystallization process by laser annealing is carried out during one laser scan, so that each of the DTFTs has the same shape and the same dimensions. In this case, the DTFT, which is included by each of pixel circuits Aij connected with the same scanning line Gi, has TFT characteristics that are substantially the same.

As such, for example, it can be alternatively configured such that one or more of the pixel circuits Aij connected with the same scanning line Gi be connected to the current feedback line BFi, so as to compensate variations in the TFT characteristics of respective DTFTs on the pixel circuits Aij, based on currents that are determined based on conductances of respective DTFTs on the one or more of the pixel circuits Aij connected with the same scanning line Gi.

By this, it is possible to prevent, with high accuracy, an image defect that occurs due to variations in the TFT characteristics among DTFTs on individual pixel circuits (i.e. variations in the TFT characteristics that occur in a sub-scanning direction of laser scanning (a direction in which the data line Sj is extended)). Concurrently with this, it is also possible to simplify a circuit configuration of a pixel circuit of the pixel circuits Aij which is not connected to the current feedback line FBi. Further, it is possible to shorten a length (occupation area) of the current feedback line FBi provided in the display area.

Third Embodiment

The following is an explanation of yet another embodiment of the present invention. It must be noted that, for the sake of an easy explanation, members operating in the same ways as in the embodiments described earlier are given the same reference numerals, and explanations thereof are omitted.

In each of First and Second Embodiments, current abilities (current determined based on conductances of DTFTs) of respective DTFTs on pixel circuits connected with the same scanning line are measured, and gate potentials of the respective DTFTs are controlled based on the current abilities thus measured, so as to compensate variations in threshold values of DTFTs between scanning lines. However, in First and Second Embodiments, it is not configured so as to compensate variations in TFT characteristics of DTFTs among pixel circuits connected with the same scanning line. In the present embodiment, in contrast, it is configured so as to compensate (i) variations in threshold values of DTFTs among scanning lines; and (ii) variations in the TFT characteristics of DTFTs among pixel circuits connected with the same scanning line.

Figure 8:
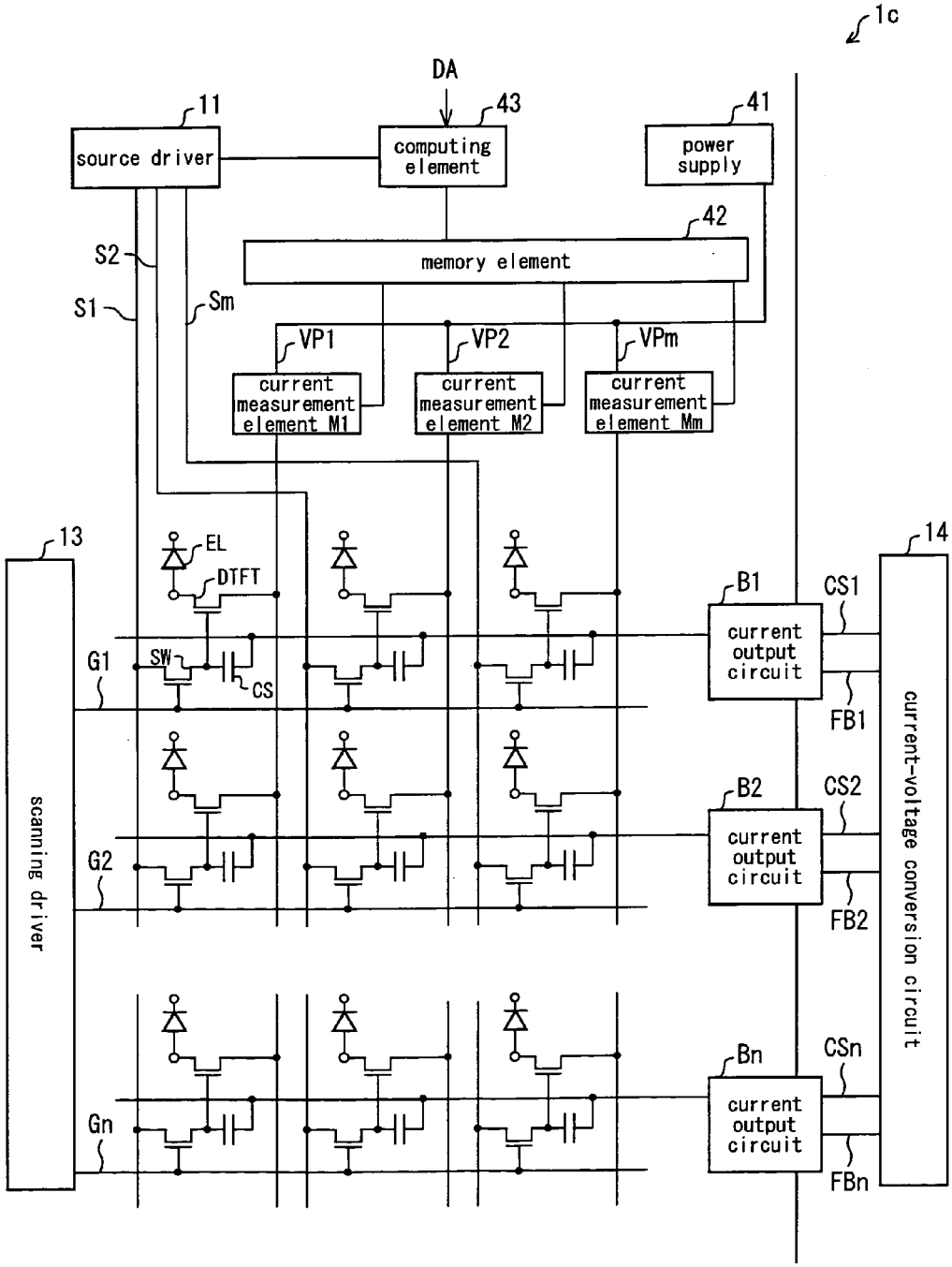
FIG. 8 is an explanatory view illustrating a schematized configuration of a display device in accordance with yet another embodiment of the present invention.
Figure 9:
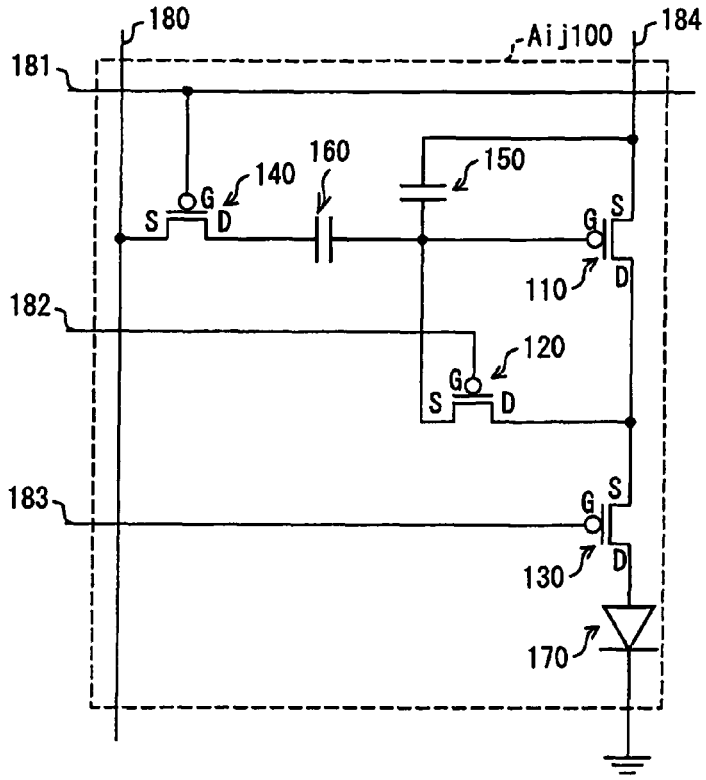
FIG. 9 is an explanatory view illustrating a configuration of a pixel circuit included in a conventional display device.
Figure 10:
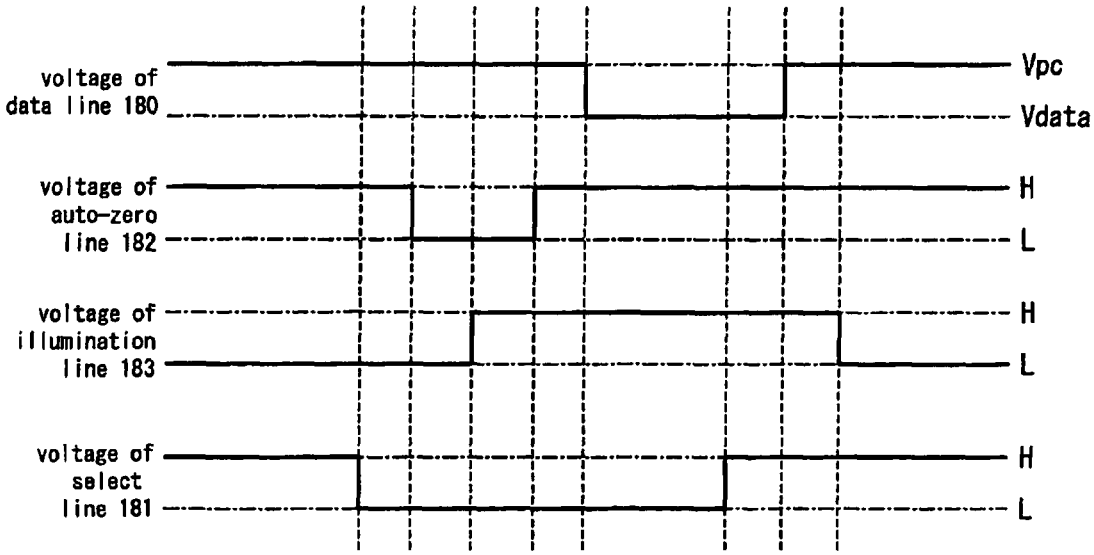
FIG. 10 is an explanatory view illustrating an operation timing in a pixel circuit 100 included in the conventional display device illustrated in FIG. 9.

FIG. 8 is an explanatory view schematically illustrating a configuration of a display device 1*c* in accordance with the present embodiment. The present embodiment deals with an example in which the display device 1 of First Embodiment is arranged so as to further include a configuration that compensates TFT characteristics of DTFTs among pixel circuits connected with the same scanning line. Alternatively, it can be configured such that the display device 1*b* of Second Embodiment is arranged so as to further include the same configuration as above.

As shown on FIG. 8, the display device 1*c*, which includes the same configuration as the display device 1 of First Embodiment, further includes current measurement elements Mj, a memory element 42, and a computing element 43.

A current measurement element Mj is provided for each of current supply lines Vpi, via which currents are supplied from a power 41 to organic EL elements EL in pixel circuits Aij. By the current measurement element Mj, a current supplied via a current supply line Vpi is measured. It must be noted that currents are supplied, via current supply lines M1 through Mm, to pixel circuits connected to respective data lines S1 to Sm.

The memory element 42, in which results of current measurements by current measurement elements Mj are stored, is connected to a source driver circuit 11 via the computing element 43.

The computing element 43 is provided between a control circuit 12 and a resistor 22 on the source driver circuit 11. Based on results of current measurements of individual current supply lines Mj which results are stored in the memory element 42, the computing element 43 corrects display data DA supplied from the control circuit 12 via individual data lines Sjin in such a manner as to compensate variations in TFT characteristics of DTFTs on individual pixel circuits. Then, the computing element 43 supplies the resistor 22 on the source driver circuit 11 with the display data having been subject to correction.

Next, the following explains (i) a method for measuring a current by a current measurement element Mj; and (ii) a result of current measurement which is to be stored in the memory element 42.

First, a scanning voltage (a voltage of H) is impressed via a scanning line Gi so that SW, which is included in each of pixel circuits A11 to Am1 provided on the scanning line Gi, is electrically conducted. It must be noted that in this case, a current output circuit Bi and a current-voltage conversion circuit 14 operate in the same ways as explained in First Embodiment. In synchronization with the conduction of the SW, a given data potential (for example, a voltage which provides a current corresponding to a current when luminance is equally divided in current-luminance characteristics) is applied via each of data lines Sj. Then, compensations are carried out in the same way as in the case with First Embodiment. Thereafter, DTFT on each of the pixel circuits A11 to Am1 is supplied, via a current supply line VPj, with a current that has been determined based on a charged amount in a capacitor Cs, which current is then supplied into an organic EL element EL provided on each of the pixel circuits A11-Am1. At this moment, the DTFT has a gate potential that has been compensated based on current abilities (for example average value) of respective DTFTs which are included in pixel circuits provided on a selected line. In accordance with this, the current to be supplied into the organic EL element EL is determined. While the current is supplied into the organic EL element EL, the current measurement element Mj measures an amount of the current. It must be noted that a result of measurement can be temporarily stored in the memory element 42 or a memory element (not shown) other than the memory element 42. The current measurement element Mj is not particularly limited in configuration, as long as an amount of a current can be measured.

After the above, a scanning voltage is impressed again via the scanning line G1 so that the SW, which is included in each of the pixel circuits A11 to Am1 provided on the scanning line G1, is electrically conducted. It must be noted that in this case, the current output circuit Bi and the current-voltage conversion circuit 14 operate in the same ways as explained in First Embodiment. In synchronization with the conduction of the SW, a data potential for causing the organic EL element EL to provide a 0 gray scale is applied via each of data lines Sj. As such, no current is to be supplied into the organic EL element EL on each of the pixel circuits A11 to Am1 provided on the scanning line G1.

Same scanning as carried out onto the scanning line G1 is sequentially carried out onto scanning lines G2 to Gn. By this, all values of currents which are supplied into organic EL elements EL are measured. Subsequently, for each current supply line VPj, an average amount or a total amount of currents supplied into organic EL elements EL on pixel circuits provided on a current supply line Vpi is calculated. Then, results of calculation are stored in the memory element 42.

It must be noted that (i) the measurement of the amounts of currents; (ii) the calculation of the average amount or the total amount of currents; and (iii) the storage of the results of calculation should be carried out at a time when, for example, (a) the display device 1*c* is manufactured; (b) an instruction is given from a user; (c) maintenance is carried out; (c) a given time has passed since above processes (i) to (iii) have been carried out; (d) a cumulative time of use of the display device 1*c* reaches a given duration, or a similar occasion.

Image display by the display device 1*c* is carried out as follows. First, with respect to display data DA which are supplied from the control circuit 12 and which correspond to individual data lines Sj, the computing element 43 performs the correction, based on one of (i) the average amount and (ii) the total amount of currents supplied via respective current supply lines VPj (both (i) and (ii) having been stored in the computing element 43), so as to compensate TFT characteristics of DTFTs among the pixel circuits Aij aligned in a direction in which the scanning line Gi is extended. After this, the display data DA is supplied to the source driver circuit 11. Thereafter, same operations as explained in First Embodiment are carried out so as to carry out the image display.

In the display device 1*c* of the present embodiment, as described so far, it is configured so as to perform in advance (i) measuring, for each pixel circuit, an amount of a current that is supplied into an organic EL element EL when a given data potential is supplied; and (ii) storing, in the memory element 42, an average amount or a total amount of currents that are supplied into pixel circuits connected with the same current supply line VPj. Thereafter, when the image display is to be carried out, the computing element 43 corrects, based on (i) the average amount or (ii) the total amount of currents thus stored in the memory element 42, the display data DA supplied from the control circuit 12 via the data lines Sj. Subsequently, the image display is carried out by driving the same operations as those driven in the First Embodiment.

By this, it is possible, as in the case with the First Embodiment, to prevent a linear image defect that occurs due to variations in TFT characteristics of DTFTs among scanning lines Gi. Further, it is also possible to prevent an image defect (irregularity of image display) that occurs due to variations in TFT characteristics of DTFTs among pixel circuits provided in a direction in which a scanning line Gi is extended. Thus, it is possible to prevent, with high accuracy, the image defects that occur due to variations in the TFT characteristics of DTFTs.

In the display device 1*c*, moreover, it is configured so as to store, in the memory element, a current value of a current having been subjected to correction in the same way as in the case with the display device 1 of First Embodiment. Therefore, as compared to the technique disclosed in the patent literature 2, it is possible to reduce a variation in a current per pixel by a degree determined based on compensation carried out with respect to each line. This allows reduction of the number of bits in the memory into which the current value of a current per pixel is stored. Thus, it is possible to reduce a storage capacity of the memory element 42.

The present invention is not limited to the description of the embodiments above, but may be altered by a person skilled in the art within the scope of the claims. That is, an embodiment based on a combination of technical means modified as appropriate within the scope of the claims is encompassed in the technical scope of the present invention.

INDUSTRIAL APPLICABILITY

The present invention can be applied to a current-controlled display device.

The invention claimed is:

1. A display device comprising:

a plurality of scanning lines;

a plurality of data lines intersecting with each of the plurality of scanning lines;

pixel circuits disposed so as to correspond to each intersection of the scanning lines and the data lines;

a source driver for supplying, to the data lines, a data potential corresponding to image data; and a scanning driver for supplying, to the scanning lines, a scanning signal to switch each of the pixel circuits between a selection period during which the data potential outputted from the source driver is supplied to each of the pixel circuits, and a non-selection period during which the data potential is not supplied to each of the pixel circuits, each of the pixel circuits comprising:

a switching TFT, whose gate terminal is connected to the scanning line and whose source terminal is connected to the data line;

a driving TFT, whose gate terminal is connected to a drain terminal of the switching TFT and whose source terminal is connected to a current supply line maintained at a power supply potential; and an optical element connected to a drain terminal of the driving TFT, a luminescence condition of the optical element varying in line with an amount of a current flowing in the optical element, the display device being a current-controlled display device displaying an image corresponding to the image data by controlling, via the driving TFT in line with the data potential, the amount of the current flowing in the optical element, each of the pixel circuits having a retention capacitor, one end of which is connected to a gate terminal of the driving TFT and the other end is connected to a capacitance feedback line, the display device further comprising:

a current-voltage conversion circuit for receiving at its input terminal a feedback current which is a current flowing in the driving TFT of a pixel circuit in the selection period at a time of supplying a predetermined potential to the gate terminal of the driving TFT, converting the feedback current into a voltage, and outputting at its output terminal a potential corresponding to the voltage; and a changeover switch to connect the capacitance feedback line to the output terminal of the current-voltage conversion circuit when the pixel circuit to which the capacitance feedback line corresponds is in the selection period and to connect the capacitance feedback line to a fixed potential supply line supplying a fixed potential when the pixel circuit to which the capacitance feedback line corresponds is in the non-selection period.

2. The display device in accordance with claim 1, wherein:

a pixel circuit provided at an end of each scanning line in an extending direction thereof is a dummy pixel circuit provided outside a display area; and when a predetermined potential is applied to a gate terminal of a driving TFT provided in the dummy pixel circuit while a pixel circuit in a display area which is connected to said each scanning line is in the selection period, a current flows in the driving TFT, and the current is inputted as the feedback current to the current-voltage conversion circuit.

3. The display device in accordance with claim 2, wherein:

the dummy pixel circuit does not include an optical element;

the driving TFT provided in the dummy pixel circuit is a dummy driving TFT having substantially same TFT characteristics as those of a driving TFT of the pixel circuit in the display area which is connected to the scanning line corresponding to the dummy pixel circuit; and when a predetermined potential is supplied to a gate terminal of the dummy driving TFT in the dummy pixel circuit corresponding to the scanning line connected to the pixel circuit in the selection period, a current flows in the dummy driving TFT, and the current is inputted as the feedback current to the current-voltage conversion circuit.

4. The display device in accordance with claim 3, wherein the dummy pixel circuit comprises:

the dummy driving TFT;

a dummy switching TFT, whose gate terminal is connected to the scanning line, whose source terminal is connected to a dummy data line used to supply a predetermined potential, and whose drain terminal is connected to the gate terminal of the dummy driving TFT; and a switching element disposed between the dummy driving TFT and an input terminal of the current-voltage conversion circuit, the switching element being connected to the scanning line, wherein the dummy switching TFT and the switching element are conductive when the pixel circuit in the display area which is connected to the scanning line corresponding to the dummy pixel circuit is in the selection period, and the dummy switching TFT and the switching element are cutoff when the pixel circuit in the display area which is connected to the scanning line corresponding to the dummy pixel circuit is in the non-selection period.

5. The display device in accordance with claim 4, wherein:

the dummy pixel circuit further comprises a second switching element connected to the gate terminal of the dummy driving TFT, and the second switching element supplies a predetermined potential to the gate terminal of the dummy driving TFT when the pixel circuit in the display area which is connected to the scanning line corresponding to the dummy pixel circuit is in the selection period, and the second switching element supplies to the gate terminal of the dummy driving TFT a potential to cutoff the dummy switching TFT when the pixel circuit in the display area which is connected to the scanning line corresponding to the dummy pixel circuit is in the non-selection period.

6. The display device in accordance with claim 2, wherein:

each driving TFTs is formed via crystallization by laser annealing, the laser annealing being conducted by scan processing in which a laser irradiation spot travels alongside an extending direction of the scanning line, the scan processing being sequentially repeated by shifting position of the scan processing in a direction perpendicular to the extending direction of the scanning line; and the dummy pixel circuit is provided:

for each scanning line; or for every group of scanning lines each connected to a pixel circuit including the driving TFT within the laser irradiation spot in one scan processing.

7. The display device in accordance with claim 2, wherein a shape and dimensions of the dummy driving TFT are substantially same as a shape and dimensions of the driving TFT included in the pixel circuit in the display area which is connected to the scanning line corresponding to the dummy pixel circuit including the dummy driving TFT.

8. The display device in accordance with claim 2, wherein:

at least one of pixel circuits connected to a same scanning line includes a switching means to switch a connection of a drain terminal of the driving TFT between the optical element and the input terminal of the current-voltage conversion circuit, the switching means being connected between the drain terminal of the driving TFT and the optical element;

during a first half of the selection period of the pixel circuit connected to the scanning line, a predetermined potential is supplied to the gate terminal of the driving TFT via the data line, and the switching means is caused to switch the connection so that the drain terminal is connected to the input terminal of the current-voltage conversion circuit in order that a current flowing in the driving TFT is inputted as a feedback current into the current-voltage conversion circuit; and during a second half of the selection period, a data potential corresponding to image data is supplied to the gate terminal of the driving TFT via the data line, and the switching means is caused to switch the connection so that the drain terminal is connected to the optical element.

9. The display device in accordance with claim 2, wherein the current-voltage conversion circuit comprises:

a current-voltage conversion element made from a diode-connected transistor; and a current mirror circuit flowing into the current-voltage conversion element a current of a same amount as an amount of the feedback current inputted into the input terminal, and the feedback current is converted into a voltage using the current-voltage conversion element, and a potential corresponding to the voltage is then outputted from the output terminal.

10. The display device in accordance with claim 9, wherein the current-voltage conversion circuit includes an amplifier having a gain of 1 or more and connected between the current-voltage conversion element and the output terminal.

11. A manufacturing method of the display device in accordance with claim 2, comprising the steps of:

forming each driving TFT via crystallization by laser annealing, the crystallization being conducted by scan processing in which a laser irradiation spot travels alongside the extending direction of the scanning line, the scan processing being sequentially repeated by shifting position of the scan processing in a direction perpendicular to the extending direction of the scanning line; and providing the dummy pixel circuit for each scanning line or for every group of scanning lines each connected to a pixel circuit including the driving TFT in a laser irradiation spot in one scanning processing.

12. The display device in accordance with claim 1, wherein the current supply line is connected to a source terminal of a driving TFT of each of pixel circuits connected to a common data line, the display device further comprising:

a storage means to store, for each current supply line, an average value or a total sum of amounts of currents for pixel circuits connected to a common current supply line, the average value or the total sum being calculated based on amounts measured in advance of currents flowing in the driving TFT of said each of pixel circuits when a predetermined potential has been supplied to the gate terminal of the driving TFT; and a correcting means to correct a data potential corresponding to image data which is supplied to each data line corresponding to the current supply line, the correction being carried out, based on the average value or the total sum stored in the storage means, in such a manner as to compensate variations in TFT characteristics of driving TFTs among pixel circuits aligned in an extending direction of the scanning line.

* * * * *